US006668470B2

(12) United States Patent
Ellis, III

(10) Patent No.: US 6,668,470 B2
(45) **Date of Patent: *Dec. 30, 2003**

(54) SHOE SOLE WITH ROUNDED INNER AND OUTER SIDE SURFACES

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/908,688

(22) Filed: Jul. 20, 2001

(65) Prior Publication Data

US 2001/0049887 A1 Dec. 13, 2001

Related U.S. Application Data

(63) Continuation of application No. 09/522,174, filed on Mar. 9, 2000, now Pat. No. 6,314,662, which is a continuation of application No. 08/477,640, filed on Jun. 7, 1995, which is a continuation of application No. 08/162,962, filed on Dec. 8, 1993, now Pat. No. 5,544,429, which is a continuation of application No. 07/930,469, filed on Aug. 20, 1992, now Pat. No. 5,317,819, which is a continuation of application No. 07/239,667, filed on Sep. 2, 1988, now abandoned.

(51) Int. Cl.[7] ..... A43B 5/00
(52) U.S. Cl. ..... 36/25 R; 36/88
(58) Field of Search ..... 36/25 R, 30 R, 36/28, 31, 32 R, 88, 91, 114, 127, 129, 69

(56) References Cited

U.S. PATENT DOCUMENTS

| | | | |
|---|---|---|---|
| 193,914 | A | 8/1877 | Berry |
| 280,791 | A | 7/1883 | Brooks |
| 288,127 | A | 11/1883 | Shepard |

(List continued on next page.)

FOREIGN PATENT DOCUMENTS

| | | |
|---|---|---|
| AT | 200963 | 5/1958 |
| CA | 1 138 194 | 12/1982 |
| CA | 1 176 458 | 10/1984 |

(List continued on next page.)

OTHER PUBLICATIONS

Dorothy Williams, "Walking on Air", Case Alumnus, vol. LXVII, No. 6, Fall 1989, pp. 4–8.

Brooks advertisement, *Runner's World*, Jun. 1989, p. 56+.

Nigg et al., Influence of Heel Flare and Midsole Construction on Pronation, Supination, and Impact Forces for Heel–Toe Running, *International Journal of Sport Biomechanics*, 1988, vol. 4, No. 3, pp. 205–219.

(List continued on next page.)

*Primary Examiner*—M. D. Patterson
(74) *Attorney, Agent, or Firm*—Knoble & Yoshida, LLC

(57) ABSTRACT

An athletic shoe sole for a shoe has side portions with concavely rounded inner and outer surfaces, as viewed in at least a heel area and a midtarsal area of the shoe sole. The rounded surfaces increasing at least one of lateral and medial stability of the sole. The concavely rounded portion of the sole outer surface located at the heel area extends substantially continuously through a sidemost part of the sole side. The rounded portion of the sole outer surface located at the midtarsal area extends up the sole side to at least a level corresponding to a lowest point of the sole inner surface. A midsole component of the shoe sole extends into the sidemost section of the sole side and also extends up the sole side to above a level corresponding to a lowest point of the sole inner surface. The concavely rounded portions of the sole midtarsal area are located at least at the sole lateral side. The sole outer surface of at least part of the midtarsal area is substantially convexly rounded, as viewed in a shoe sole sagittal plane.

47 Claims, 12 Drawing Sheets

U.S. PATENT DOCUMENTS

| | | | | |
|---|---|---|---|---|
| 500,385 | A | 6/1893 | Hall | |
| 532,429 | A | 1/1895 | Rogers | |
| 584,373 | A | 6/1897 | Kuhn | |
| 1,283,335 | A | 10/1918 | Shillcock | |
| 1,289,106 | A | 12/1918 | Bullock | |
| D55,115 | S | 5/1920 | Barney | |
| 1,458,446 | A | 6/1923 | Shaeffer | |
| 1,622,860 | A | 3/1927 | Cutler | |
| 1,639,381 | A | 8/1927 | Manelas | |
| 1,701,260 | A | 2/1929 | Fischer | |
| 1,735,986 | A | 11/1929 | Wray | |
| 1,853,034 | A | 4/1932 | Bradley | |
| 1,870,751 | A | 8/1932 | Reach | |
| 2,120,987 | A | 6/1938 | Murray | |
| 2,124,986 | A | 7/1938 | Pipes | |
| 2,147,197 | A | 2/1939 | Glidden | |
| 2,155,166 | A | 4/1939 | Kraft | |
| 2,162,912 | A | 6/1939 | Craver | |
| 2,170,652 | A | 8/1939 | Brennan | |
| 2,179,942 | A | 11/1939 | Lyne | |
| D119,894 | S | 4/1940 | Sherman | |
| 2,201,300 | A | 5/1940 | Prue | |
| 2,206,860 | A | 7/1940 | Sperry | |
| D122,131 | S | 8/1940 | Sannar | |
| D128,817 | S | 8/1941 | Esterson | |
| 2,251,468 | A | 8/1941 | Smith | |
| 2,328,242 | A | 8/1943 | Witherill | |
| 2,345,831 | A | 4/1944 | Pierson | |
| 2,433,329 | A | 12/1947 | Adler et al. | |
| 2,434,770 | A | 1/1948 | Lutey | |
| 2,470,200 | A | 5/1949 | Wallach | |
| 2,627,676 | A | 2/1953 | Hack | |
| 2,718,715 | A | 9/1955 | Spilman | |
| 2,814,133 | A | 11/1957 | Herbst | |
| 3,005,272 | A | 10/1961 | Shelare et al. | |
| 3,100,354 | A | 8/1963 | Lombard et al. | |
| 3,110,971 | A | 11/1963 | Chang | |
| 3,305,947 | A | 2/1967 | Kalsoy | |
| 3,308,560 | A | 3/1967 | Jones | |
| 3,416,174 | A | 12/1968 | Novitske | |
| 3,512,274 | A | 5/1970 | McGrath | |
| 3,535,799 | A | 10/1970 | Onitsuka | |
| 3,806,974 | A | 4/1974 | Di Paolo | |
| 3,824,716 | A | 7/1974 | Di Paolo | |
| 3,863,366 | A | 2/1975 | Auberry et al. | |
| 3,958,291 | A | 5/1976 | Spier | |
| 3,964,181 | A | 6/1976 | Holcombe, Jr. | |
| 3,997,984 | A | 12/1976 | Hayward | |
| 4,003,145 | A | 1/1977 | Liebscher et al. | |
| 4,030,213 | A | 6/1977 | Daswick | |
| 4,043,058 | A | 8/1977 | Hollister et al. | 36/102 |
| 4,068,395 | A | 1/1978 | Senter | |
| 4,083,125 | A | 4/1978 | Benseler et al. | |
| 4,096,649 | A | 6/1978 | Saurwein | |
| 4,098,011 | A | 7/1978 | Bowerman et al. | |
| 4,128,950 | A | 12/1978 | Bowerman et al. | 36/30 |
| 4,128,951 | A | 12/1978 | Tansill | |
| 4,141,158 | A | 2/1979 | Benseler et al. | |
| 4,145,785 | A | 3/1979 | Lacey | |
| 4,149,324 | A | 4/1979 | Lesser et al. | |
| 4,161,828 | A | 7/1979 | Benseler et al. | |
| 4,161,829 | A | 7/1979 | Wayser | |
| 4,170,078 | A | 10/1979 | Moss | |
| 4,183,156 | A | 1/1980 | Rudy | |
| 4,194,310 | A | 3/1980 | Bowerman | |
| D256,180 | S | 8/1980 | Turner | D2/317 |
| D256,400 | S | 8/1980 | Famolare, Jr. | D2/319 |
| 4,217,705 | A | 8/1980 | Donzis | |
| 4,219,945 | A | 9/1980 | Rudy | |
| 4,223,457 | A | 9/1980 | Borgeas | |
| 4,227,320 | A | 10/1980 | Borgeas | |
| 4,235,026 | A | 11/1980 | Plagenhoef | |
| 4,237,627 | A | 12/1980 | Turner | 36/129 |
| 4,240,214 | A | 12/1980 | Sigle et al. | |
| 4,241,523 | A | 12/1980 | Daswick | |
| 4,245,406 | A | 1/1981 | Landay et al. | |
| 4,250,638 | A | 2/1981 | Linnemann | |
| 4,258,480 | A | 3/1981 | Famolare, Jr. | |
| 4,259,792 | A | 4/1981 | Halberstadt | |
| 4,262,433 | A | 4/1981 | Hagg et al. | |
| 4,263,728 | A | 4/1981 | Frecentese | |
| 4,266,349 | A | 5/1981 | Schmohl | |
| 4,268,980 | A | 5/1981 | Gudas | |
| 4,271,606 | A | 6/1981 | Rudy | 36/28 |
| 4,272,858 | A | 6/1981 | Hlustik | |
| 4,274,211 | A | 6/1981 | Funck | |
| 4,297,797 | A | 11/1981 | Meyers | |
| 4,302,892 | A | 12/1981 | Adamik | |
| 4,305,212 | A | 12/1981 | Coomer | |
| 4,308,671 | A | 1/1982 | Bretschneider | |
| 4,309,832 | A | 1/1982 | Hunt | |
| 4,314,413 | A | 2/1982 | Dassler | 36/129 |
| 4,316,332 | A | 2/1982 | Giese et al. | |
| 4,316,335 | A | 2/1982 | Giese et al. | |
| 4,319,412 | A | 3/1982 | Muller et al. | |
| D264,017 | S | 4/1982 | Turner | D2/309 |
| 4,322,895 | A | 4/1982 | Hockerson | |
| D265,019 | S | 6/1982 | Vermonet | D2/319 |
| 4,335,529 | A | 6/1982 | Badalamenti | |
| 4,340,626 | A | 7/1982 | Rudy | |
| 4,342,161 | A | 8/1982 | Schmohl | |
| 4,348,821 | A | 9/1982 | Daswick | |
| 4,354,319 | A | 10/1982 | Block et al. | |
| 4,361,971 | A | 12/1982 | Bowerman | |
| 4,366,634 | A | 1/1983 | Giese et al. | |
| 4,370,817 | A | 2/1983 | Ratanangsu | |
| 4,372,059 | A | 2/1983 | Ambrose | |
| 4,398,357 | A | 8/1983 | Batra | |
| 4,399,620 | A | 8/1983 | Funck | |
| D272,294 | S | 1/1984 | Watanabe | D2/309 |
| 4,449,306 | A | 5/1984 | Cavanagh | |
| 4,451,994 | A | 6/1984 | Fowler | |
| 4,454,662 | A | 6/1984 | Stubblefield | |
| 4,455,765 | A | 6/1984 | Sjöswärd | |
| 4,455,767 | A | 6/1984 | Bergmans | |
| 4,468,870 | A | 9/1984 | Sternberg | |
| 4,484,397 | A | 11/1984 | Curley, Jr. | |
| 4,494,321 | A | 1/1985 | Lawlor | |
| 4,505,055 | A | 3/1985 | Bergmans | |
| 4,506,462 | A | 3/1985 | Cavanagh | |
| 4,521,979 | A | 6/1985 | Blaser | |
| 4,527,345 | A | 7/1985 | Lopez Lopez | |
| D280,568 | S | 9/1985 | Stubblefield | D2/319 |
| 4,542,598 | A | 9/1985 | Misevich et al. | |
| 4,546,559 | A | 10/1985 | Dassler | |
| 4,557,059 | A | 12/1985 | Misevich et al. | |
| 4,559,723 | A | 12/1985 | Hamy et al. | |
| 4,559,724 | A | 12/1985 | Norton | |
| 4,561,195 | A | 12/1985 | Onoda et al. | |
| 4,577,417 | A | 3/1986 | Cole | |
| 4,578,882 | A | 4/1986 | Talarico, II | |
| 4,580,359 | A | 4/1986 | Kurrash et al. | |
| 4,624,061 | A | 11/1986 | Wezel et al. | |
| 4,624,062 | A | 11/1986 | Autry | |
| 4,641,438 | A | 2/1987 | Laird et al. | |
| 4,642,917 | A | 2/1987 | Ungar | |
| 4,651,445 | A | 3/1987 | Hannibal | |
| D289,341 | S | 4/1987 | Turner | D2/322 |
| 4,670,995 | A | 6/1987 | Huang | |
| 4,676,010 | A | 6/1987 | Cheskin | |
| 4,694,591 | A | 9/1987 | Banich et al. | |

| | | | | |
|---|---|---|---|---|
| 4,697,361 | A | 10/1987 | Ganter et al. | |
| D293,275 | S | 12/1987 | Bua | |
| 4,715,133 | A | 12/1987 | Hartjes et al. | |
| 4,724,622 | A | 2/1988 | Mills | |
| D294,425 | S | 3/1988 | Le | |
| 4,727,660 | A | 3/1988 | Bernhard | |
| 4,730,402 | A | 3/1988 | Norton et al. | |
| 4,731,939 | A | 3/1988 | Parracho et al. | |
| 4,747,220 | A | 5/1988 | Autry et al. | |
| D296,149 | S | 6/1988 | Diaz | |
| D296,152 | S | 6/1988 | Selbiger | |
| 4,748,753 | A | 6/1988 | Ju | |
| 4,754,561 | A | 7/1988 | Dufour | |
| 4,756,098 | A | 7/1988 | Boggia | |
| 4,757,620 | A | 7/1988 | Tiitola | |
| 4,759,136 | A | 7/1988 | Stewart et al. | |
| 4,768,295 | A | 9/1988 | Ito | |
| 4,769,926 | A | 9/1988 | Meyers | 36/43 |
| D298,684 | S | 11/1988 | Pitchford | D2/264 |
| 4,785,557 | A | 11/1988 | Kelley et al. | |
| 4,817,304 | A | 4/1989 | Parker et al. | |
| 4,827,631 | A | 5/1989 | Thornton | |
| 4,833,795 | A | 5/1989 | Diaz | |
| 4,837,949 | A | 6/1989 | Dufour | |
| D302,900 | S | 8/1989 | Kolman et al. | D2/264 |
| 4,854,057 | A | 8/1989 | Misevich et al. | |
| 4,858,340 | A | 8/1989 | Pasternak | |
| 4,866,861 | A | 9/1989 | Noone | |
| 4,876,807 | A | 10/1989 | Tiitola et al. | |
| 4,890,398 | A | 1/1990 | Thomasson | |
| 4,894,933 | A | 1/1990 | Tonkel et al. | 36/28 |
| 4,897,936 | A | 2/1990 | Fuerst | 36/30 |
| 4,906,502 | A | 3/1990 | Rudy | |
| 4,934,070 | A | 6/1990 | Mauger | |
| 4,934,073 | A | 6/1990 | Robinson | |
| D310,131 | S | 8/1990 | Hase | D2/264 |
| D310,132 | S | 8/1990 | Hase | D2/264 |
| 4,947,560 | A | 8/1990 | Fuerst et al. | |
| 4,949,476 | A | 8/1990 | Anderie | |
| D310,906 | S | 10/1990 | Hase | D2/204 |
| 4,982,737 | A | 1/1991 | Guttmann | |
| 4,989,349 | A | 2/1991 | Ellis, III | |
| D315,634 | S | 3/1991 | Yung-Mao | |
| 5,010,662 | A | 4/1991 | Dabuzhsky et al. | |
| 5,014,449 | A | 5/1991 | Richard et al. | |
| 5,024,007 | A | 6/1991 | DuFour | |
| 5,025,573 | A | 6/1991 | Giese et al. | |
| D320,302 | S | 10/1991 | Kiyosawa | D2/264 |
| 5,052,130 | A | 10/1991 | Barry et al. | |
| 5,077,916 | A | 1/1992 | Beneteau | |
| 5,079,856 | A | 1/1992 | Truelsen | |
| 5,092,060 | A | 3/1992 | Frachey et al. | |
| D327,164 | S | 6/1992 | Hatfield | D2/264 |
| D327,165 | S | 6/1992 | Harfield | D2/264 |
| 5,131,173 | A | 7/1992 | Anderie | |
| D328,968 | S | 9/1992 | Tinker | D2/264 |
| D329,528 | S | 9/1992 | Hatfield | D2/264 |
| D329,739 | S | 9/1992 | Hatfield | D2/264 |
| D330,972 | S | 11/1992 | Hatfield et al. | D2/264 |
| D332,344 | S | 1/1993 | Hatfield et al. | D2/264 |
| D332,692 | S | 1/1993 | Hatfield et al. | D2/319 |
| 5,191,727 | A | 3/1993 | Barry et al. | 36/107 |
| 5,224,280 | A | 7/1993 | Preman et al. | |
| 5,224,810 | A | 7/1993 | Pitkin | |
| 5,237,758 | A | 8/1993 | Zachman | |
| D347,105 | S | 5/1994 | Johnson | D2/896 |
| 5,317,819 | A | 6/1994 | Ellis, III | |
| 5,369,896 | A | 12/1994 | Frachey et al. | 36/29 |
| D372,114 | S | 7/1996 | Tunre et al. | D2/969 |
| 5,543,194 | A | 8/1996 | Rudy | |
| 5,544,429 | A | 8/1996 | Ellis, III | |
| 5,572,805 | A | 11/1996 | Giese et al. | 36/30 |
| D388,594 | S | 1/1998 | Turner et al. | 2/902 |
| D409,362 | S | 5/1999 | Turner et al. | D2/902 |
| D409,826 | S | 5/1999 | Tuner et al. | D2/955 |
| D410,138 | S | 5/1999 | Turner et al. | D2/959 |
| 5,909,948 | A | 6/1999 | Ellis, III | |
| 6,115,941 | A | 9/2000 | Ellis, III | |
| 6,115,945 | A | 9/2000 | Ellis, III | |
| 6,163,982 | A | 12/2000 | Ellis, III | |
| D444,293 | S | 7/2001 | Turner et al. | D2/958 |
| D450,916 | S | 11/2001 | Turner et al. | D2/896 |

FOREIGN PATENT DOCUMENTS

| | | | |
|---|---|---|---|
| DE | B 23257 VII/71a | | 5/1956 |
| DE | 1918131 | | 6/1965 |
| DE | 1918132 | | 6/1965 |
| DE | 1 287 477 | | 1/1969 |
| DE | 1 290 844 | | 3/1969 |
| DE | 2036062 | | 7/1970 |
| DE | 1948620 | | 5/1971 |
| DE | 1685293 | | 7/1971 |
| DE | 1 685 260 | | 10/1971 |
| DE | 2045430 | | 3/1972 |
| DE | 2522127 | | 11/1976 |
| DE | 2525613 | | 12/1976 |
| DE | 2602310 | | 7/1977 |
| DE | 2613312 | | 10/1977 |
| DE | 27 06 645 | A1 | 8/1978 |
| DE | 2654116 | | 1/1979 |
| DE | 27 37 765 | A1 | 3/1979 |
| DE | 28 05 426 | A1 | 8/1979 |
| DE | 3021936 | | 4/1981 |
| DE | 8219616.8 | | 9/1982 |
| DE | 3113295 | | 10/1982 |
| DE | 32 45 182 | A1 | 5/1983 |
| DE | 33 17 462 | A1 | 10/1983 |
| DE | 3347343 | | 7/1985 |
| DE | 8530136.1 | | 2/1988 |
| DE | 36 29 245 | A1 | 3/1988 |
| EP | 0 048 965 | A2 | 9/1981 |
| EP | 0 083 449 | A1 | 7/1983 |
| EP | 0 130 816 | A2 | 1/1985 |
| EP | 0 185 781 | A1 | 7/1986 |
| EP | 0207063 | | 10/1986 |
| EP | 0 206 511 | A3 | 12/1986 |
| EP | 0 213 257 | A3 | 3/1987 |
| EP | 0 215 974 | A1 | 4/1987 |
| EP | 0 238 995 | A2 | 9/1987 |
| EP | 0 260 777 | A2 | 3/1988 |
| EP | 0 301 331 | A2 | 2/1989 |
| EP | 0 410 087 | A2 | 1/1991 |
| EP | 0 329 391 | B1 | 5/1995 |
| FR | 602.501 | | 3/1926 |
| FR | 925.961 | | 9/1947 |
| FR | 1.004.472 | | 3/1952 |
| FR | 1245672 | | 10/1960 |
| FR | 1.323.455 | | 2/1963 |
| FR | 2 006 270 | | 12/1969 |
| FR | 2 261 721 | | 9/1975 |
| FR | 2 511 850 | | 3/1983 |
| FR | 2 622 411 | | 5/1989 |
| GB | 16143 | | 9/1891 |
| GB | 9591 | | 11/1913 |
| GB | 764956 | | 1/1957 |
| GB | 807305 | | 1/1959 |
| GB | 1504615 | | 3/1978 |
| GB | 2 023 405 | | 1/1980 |
| GB | 2 039 717 | | 8/1980 |
| GB | 2076633 | | 12/1981 |
| GB | 2133668 | | 8/1984 |
| GB | 2 136 670 | | 9/1984 |

| | | |
|---|---|---|
| JP | 39-15597 | 8/1964 |
| JP | 45-5154 | 3/1970 |
| JP | 50-71132 | 11/1975 |
| JP | 57-139333 | 8/1982 |
| JP | 59-23525 | 7/1984 |
| JP | 61-55810 | 4/1986 |
| JP | 1129505 | 6/1986 |
| JP | 61-167810 | 10/1986 |
| JP | 1-195803 | 8/1989 |
| JP | 2136505 | 5/1990 |
| JP | 2279103 | 11/1990 |
| JP | 3-85102 | 4/1991 |
| JP | 3086101 | 4/1991 |
| JP | 4-279102 | 10/1992 |
| JP | 5-123204 | 5/1993 |
| NZ | 189890 | 9/1981 |
| WO | WO 87/07480 | 12/1987 |
| WO | WO8707481 | 12/1987 |
| WO | WO 88/08263 | 11/1988 |
| WO | WO 89/06500 | 7/1989 |
| WO | WO 90/00358 | 1/1990 |
| WO | WO 91/00698 | 1/1991 |
| WO | WO 91/03180 | 3/1991 |
| WO | WO 91/04683 | 4/1991 |
| WO | WO 91/05491 | 5/1991 |
| WO | WO 91/10377 | 7/1991 |
| WO | WO 91/11124 | 8/1991 |
| WO | WO 91/11924 | 8/1991 |
| WO | WO 91/19429 | 12/1991 |
| WO | WO 92/07483 | 5/1992 |
| WO | WO 92/18024 | 10/1992 |
| WO | WO 93/13928 | 7/1993 |
| WO | WO 94/03080 | 2/1994 |
| WO | WO 97/00029 | 1/1997 |
| WO | WO 00/64293 | 11/2000 |

OTHER PUBLICATIONS

Nigg et al., The influence of lateral heel flare of running shoes on pronation and impact forces, *Medicine and Science in Sports and Exercise*, vol. 19, No. 3, 1987, pp. 294–302.

*The Reebok Lineup*, Fall 1987.

P.R. Cavanagh et al., "Biological Aspects of modeling Shoe/Foot Interaction During Running," *Sport Shoes and Playing Surfaces*, 1984, pp. 24–25; 32–35; 46.

Erich Blechschmidt, The Structure of the Calcaneal Padding, *Foot & Ankle*, vol. 2, No. 5, Mar. 1982, pp. 260–283.

Cavanagh, *The Running Shoe Book*, 1980, pp. 176–180.

German description of adidas badminton shoe pre–(1989)?, 1 page.

Ellis, *Executive Summary* with 7 figures attached.

Johnson et al., <<A Biomechanicl Approach to the Design of Football Boots>>, *Journal of Biomechanics*, vol. 9, pp. 581–585 (1976).

Fixx, *The Complete Book of Running*, pp 134–137 1977.

Romika Catalog, Summer 1978.

Adidas shoe, << Model Water Competition >> 1980.

World Professional Squash Association Pro Tour Program, 1982–1983.

Williams et al., << The Mechanics of Foot Action During The GoldSwing and Implications for Shoe Design >>, *Medicine and Science in Sports and Exercise*, vol. 15, No. 3, pp. 247–255 1983.

Nigg et al., << Biomechanical Aspects of Sport Shoes and Playing Surfaces >>, *Proceedings of the International Symposium on Biomechanical Aspects of Sport Shoes and Playing Surfaces*, 1983.

Valiant et al., << A Study of Landing from a Jump : Implications for the Design of a Basketball Shoe >>, *Scientific Program of IX Internatioanl Congress of Biomechanics*, 1983.

Frederick, *Sports Shoes and Playing Surfaces, Biomechanical Properties*, Entire Book, 1984.

Saucony Spot–bilt Catalog Supplement, Spring 1985.

Adidas shoe, Model <<Fire >> 1985.

Adidas shoe, Model "Tolio H.", 1985.

Adidas shoe, Model "Buffalo" 1985.

Adidas shoe, Model, "Marathon" 86 1985.

Adidas shoe, Model << Boston Super>> 1985.

Leuthi et al., << Influence of Shoe Construction on Lower Extremity Kinematics and Load During Lateral Movements In Tennis>>, *International Journal of Sport Biomechanics,* , vol. 2, pp 166–174 1986.

Nigg et al., *Biomechanics of Running Shoes*, entire book, 1986.

Runner's World, Oct. 1986.

AVIA Catalog 1986.

Brooks Catalog 1986.

Adidas Catalog 1986.

adidas shoe, << Model Questar>>, 1986.

adidas shoe, Model "London" 1986.

adidas shoe, Model << Marathon >> 1986.

adidas shoe, Model << Tauern >> 1986.

adidas shoe, Model << Kingscup Indoor >>, 1986.

Komi et al., "Interaction Between Man and Shoe in Running: Considerations for More Comprehensive Measurement Approach", *International Journal of Sports Medicine*, vol. 8, pp. 196–202 1987.

Nigg et al., >> The Influence of Lateral Heel Flare of Running Shoes on Protraction and Impact Forces >>, *Medicine and Science in Sports and Exercise*, vol. 19, No. 3, pp. 294–302 1987.

Nigg, << Biomechanical Analysis of Ankle and foot Movement >> *Medicine and Sport Science*, vol. 23, pp 22–29 1987.

*The Complete Handbook of Athletic Footwear*, Entire book, 1987.

Saucony Spot–bilt shoe, *The Complete Handbook of Athletic Footwear*, pp 332, 1987.

Puma basketball shoe, *The Complete Handbook of Athletic Footwear*, pp 315, 1987.

Adidas shoe, Model, << Indoor Pro >> 1987.

Adidas Catalog, 1987.

Adidas Catalog, Spring 1987.

Nike Fall Catalog 1987, pp 50–51.

Footwear Journal, Nike Advertisement, Aug. 1987.

Sporting Goods Business, Aug. 1987.

Nigg et al., "Influence of Hell Flare and Midsole Construction on Pronation" *Internationial Journal of Sport Biomechanics*, vol. 4, No. 3, pp 205–219, (1987).

Vagenas et al., << Evaluationm of Rearfoot Asymmetrics in Running With Worn and New Running Shoes >>, *International Journal of Sport Biomechanics*, vol., 4, No. 4, pp 342–357 (1988).

Fineagan, "Comparison of the Effects of a Running Shoe and A Racing Flat on the Lower Extremity Biomechanical Alignment of Runners", *Journal of the American Physical Therapy Association*, vol., 68, No. 5, p 806 (1988).

Nawoczenside et al., >> Effect of Rocker Sole Design on Plantar Forefoot Pressures >> *Journal of the American Podiatric Medical Association*, vol. 79, No. 9, pp 455–460, 1988.
Sprts Illustrated, Special Preview Issue, The Summer Olympics << Seoul '88 >> Reebok Advertistement.
Sports Illustrated, Nike Advertisement, Aug. 8, 1988.
Runner's World, "Shoe Review" Nov. 1988 pp 46–74.
Footwear Nows, Special Supplement, Feb. 8, 1988.
Footwear New, vol. 44, No. 37, Nike Advertisement (1988).
Saucony Spot–bilt Catalog 1988.
Runner's World, Apr. 1988.
Footwear News, Special Supplement, Feb. 8, 1988.
Kronos Catalog, 1988.
Avia Fall Catalog 1988.
Nike shoe, Model << High Jump 88 >>, 1988.
Nike shoe, Model << Zoom Street Leather >> 1988.
Nike shoe, Model, << Leather Cortex® >>, 1988.
Nike shoe, Model <<Air Revolution >> #15075, 1988.
Nike shoe, Model "Air Force" #1978, 1988.
Nike shoe, Model << Air Flow << #718, 1988.
Nike shoe, Model "Air" #1553, 1988.
Nike shoe, Model << Air >>, #13213 1988.
Nike shoe, Model << Air >>, #4183, 1988.
Nike Catalog, Footwear Fall, 1988.
Adidas shoe Model "Skin Racer" 1988.
Adidas shoe, Model <<Tennis Comfort >> 1988.
Adidas Catalog 1988.
Segesser et al., "Surfing Shoe", *The Shoe in Sport*, 1989, (Translation of a book published in Germany in 1987), pp 106–110.
Palamarchuk et al., "In shoe Casting Technique for Specialized Sports Shoes", *Journal of the America, Podiatric Medical Association*, vol. 79, No. 9, pp 462–465 1989.
Runner's World, "Spring Shoe Survey", pp 45–74.
Footwear News, vol., 45, No. 5, Nike Advertisement 1989.
Nike Spring Catalog 1989 pp 62–63.
Prince Cross–Sport 1989.
Adidas Catalog 1989.
Adidas Spring Catalog 1989.
Adidas Autumn Catalog 1989.
Nike Shoe, men's cross–training Model "Air Trainer SC" 1989.
Nike shoe, men's cross–training Model << Air Trainer TW >> 1989.
Adidas shoe, Model "Torsion Grand Slam Indoor", 1989.
adidas shoe, Model << Torsion ZC 9020 S >> 1989.
adidas shoe, Model <<Torison Special HI>> 1989.
Areblad et al., << Three–Dimensional Measurement of Rearfoot Motion During Running >> *Journal of Biomechanics*, vol., 23, pp 933–940 (1990).
Cavanagh et al., "Biomechanics of Distance Running", Human Kinetics Books, pp 155–164 1990.
adidas Catalog 1990.
adidas Catalog 1991.
K–Swiss Catalog, Fall 1991.

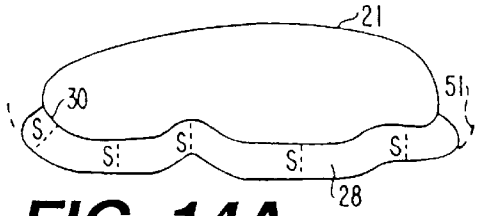
FIG. 14A
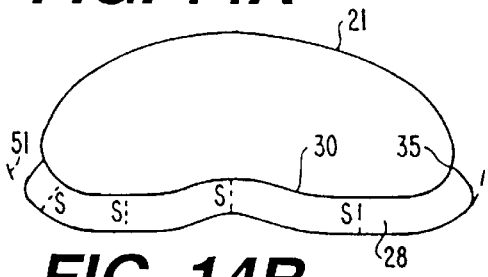
FIG. 14B
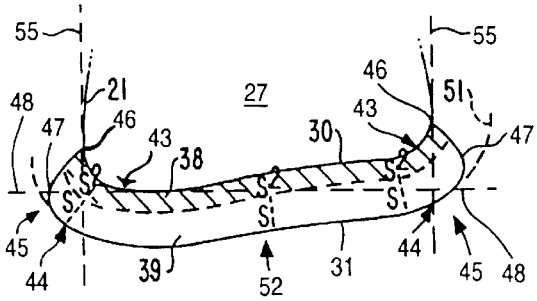
FIG. 14C
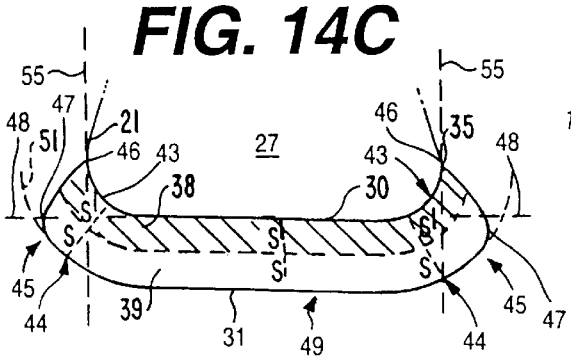
FIG. 14D
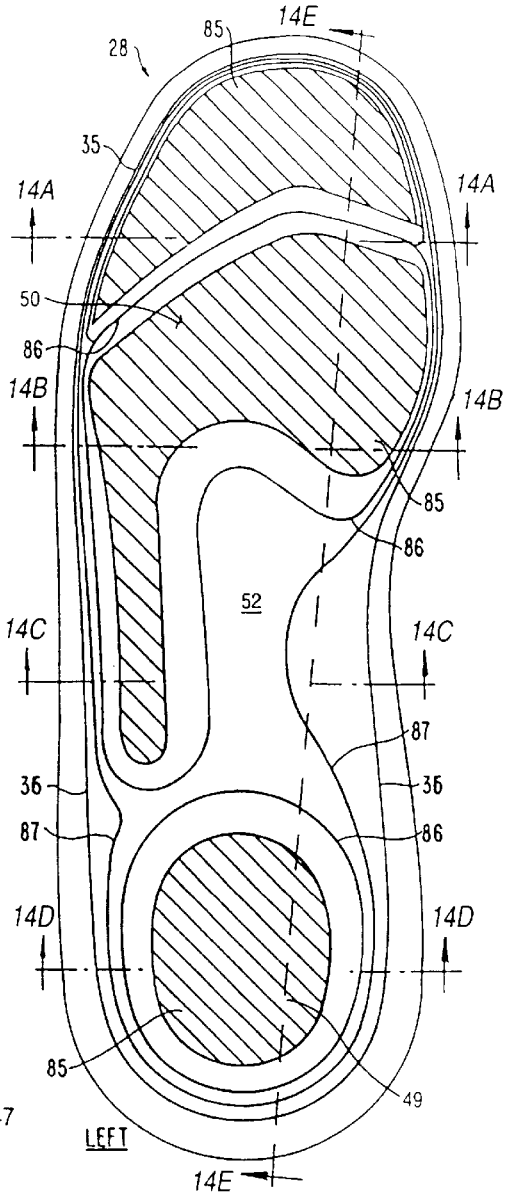
FIG. 14F
FIG. 14E
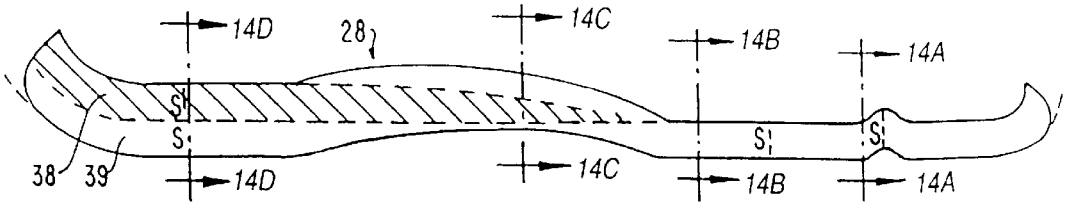

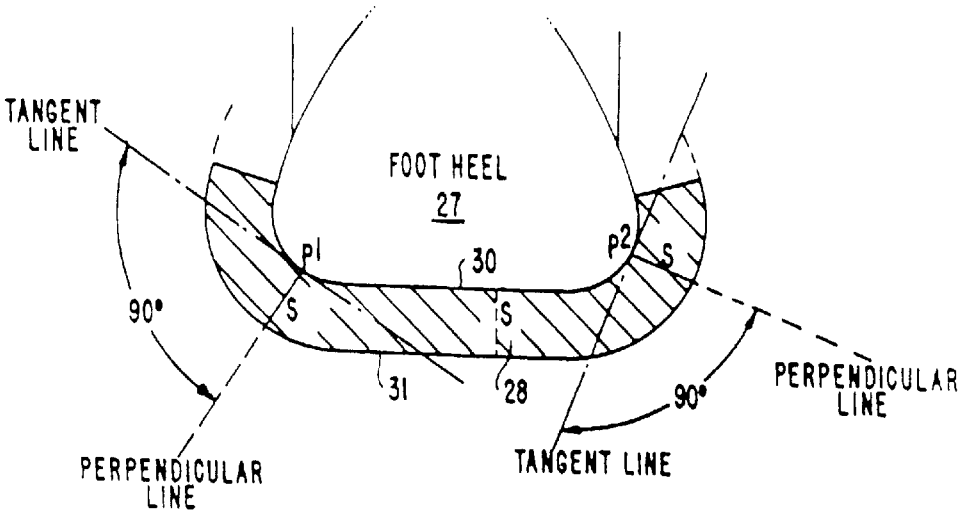
FIG. 17
FIG. 18
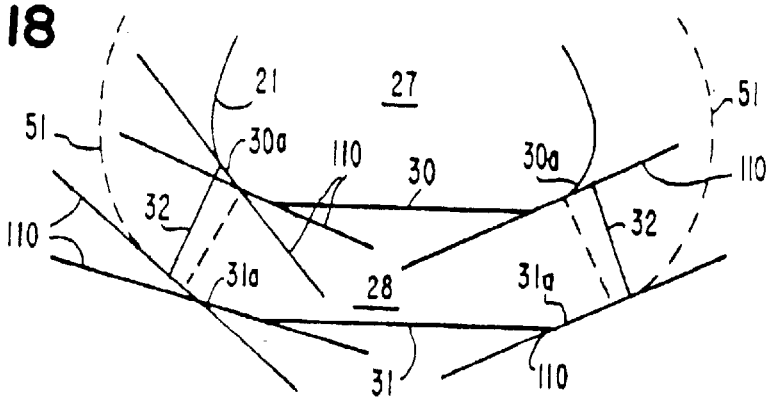

SHOE SOLE WITH ROUNDED INNER AND OUTER SIDE SURFACES

CONTINUATION DATA

This application is a continuation of U.S. application Ser. No. 09/522,174, filed Mar. 9, 2000, now U.S. Pat. No. 6,314,662, which is a continuation of U.S. application Ser. No. 08/477,640, filed Jun. 7, 1995, now pending, which is a continuation of U.S. application Ser. No. 08/162,962, filed Dec. 8, 1993, now U.S. Pat. No. 5,544,429, which is a continuation of U.S. application Ser. No. 07/930,469, filed Aug. 20, 1992, now U.S. Pat. No. 5,317,819, which is a continuation of U.S. application Ser. No. 07/239,667, filed Sep. 2, 1988, now abandoned.

BACKGROUND OF THE INVENTION

This invention relates to a shoe, such as a street shoe, athletic shoe, and especially a running shoe with a contoured sole. More particularly, this invention relates to a novel contoured sole design for a running shoe which improves the inherent stability and efficient motion of the shod foot in extreme exercise. Still more particularly, this invention relates to a running shoe wherein the shoe sole conforms to the natural shape of the foot, particularly the sides, and has a constant thickness in frontal plane cross sections, permitting the foot to react naturally with the ground as it would if the foot were bare, while continuing to protect and cushion the foot.

By way of introduction, barefoot populations universally have a very low incidence of running "overuse" injuries, despite very high activity levels. In contrast, such injuries are very common in shoe shod populations, even for activity levels well below "overuse". Thus, it is a continuing problem with a shod population to reduce or eliminate such injuries and to improve the cushioning and protection for the foot. It is an understanding of the reasons for such problems, and proposing a novel solution to the problems, to which this improved shoe is directed.

A wide variety of designs are available for running shoes which are intended to provide stability, but which lead to a constraint in the natural efficient motion of the foot and ankle. However, such designs which can accommodate free, flexible motion in contrast create a lack of control or stability. A popular existing shoe design incorporates an inverted, outwardly-flared shoe sole wherein the ground engaging surface is wider than the heel engaging portion. However, such shoes are unstable in extreme situations because the shoe sole, when inverted or on edge, immediately becomes supported only by the sharp bottom sole edge. The entire weight of the body, multiplied by a factor of approximately three at running peak, is concentrated at the sole edge. Since an unnatural lever arm and a force moment are created under such conditions, the foot and ankle are destabilized. When the destabilization is extreme, beyond a certain point of rotation about the pivot point of the shoe sole edge, ankle strain occurs. In contrast, the unshod foot is always in stable equilibrium without a comparable lever arm or force moment. At its maximum range of inversion motion, about 20°, the base of support on the barefoot heel actually broadens substantially as the calcaneal tuberosity contacts the ground. This is in contrast to the conventionally available shoe sole bottom which maintains a sharp, unstable edge.

It is thus an overall objective of this invention to provide a novel shoe design which approximates the barefoot. It has been discovered, by investigating the most extreme range of ankle motion to near the point of ankle sprain, that the abnormal motion of an inversion ankle sprain, which is a tilting to the outside or an outward rotation of the foot, is accurately simulated while stationary. With this observation, it can be seen that the extreme range stability of the conventionally shod foot is distinctly inferior to the barefoot and that the shoe itself creates a gross instability which would otherwise not exist.

Even more important, a normal barefoot running motion, which approximately includes a 7° inversion and a 7° eversion motion, does not occur with shod feet, where a 30° inversion and eversion is common. Such a normal barefoot motion is geometrically unattainable because the average running shoe heel is approximately 60% larger than the width of the human heel. As a result, the shoe heel and the human heel cannot pivot together in a natural manner; rather, the human heel has to pivot within the shoe but is resisted from doing so by the shoe heel counter, motion control devices, and the lacing and binding of the shoe upper, as well as various types of anatomical supports interior to the shoe.

Thus, it is an overall objective to provide an improved shoe design which is not based on the inherent contradiction present in current shoe designs which make the goals of stability and efficient natural motion incompatible and even mutually exclusive. It is another overall object of the invention to provide a new contour design which simulates the natural barefoot motion in running and thus avoids the inherent contradictions in current shoe designs.

It is another objective of this invention to provide a running shoe which overcomes the problems of the prior art.

It is another objective of this invention to provide a shoe wherein the outer extent of the flat portion of the sole of the shoe includes all of the support structures of the foot but which extends no further than the outer edge of the flat portion of the foot sole so that the transverse or horizontal plane outline of the top of the flat portion of the shoe sole coincides as nearly as possible with the load-bearing portion of the foot sole.

It is another objective of the invention to provide a shoe having a sole which includes a side contoured like the natural form of the side or edge of the human foot and conforming to it.

It is another objective of this invention to provide a novel shoe structure in which the contoured sole includes a shoe sole thickness that is precisely constant in frontal plane cross sections, and therefore biomechanically neutral, even if the shoe sole is tilted to either side, or forward or backward.

It is another objective of this invention to provide a shoe having a sole fully contoured like and conforming to the natural form of the non-load-bearing human foot and deforming under load by flattening just as the foot does.

It is still another objective of this invention to provide a new stable shoe design wherein the heel lift or wedge increases in the sagittal plane the thickness of the shoe sole or toe taper decrease therewith so that the sides of the shoe sole which naturally conform to the sides of the foot also increase or decrease by exactly the same amount, so that the thickness of the shoe sole in a frontal planar cross section is always constant.

These and other objectives of the invention will become apparent from a detailed description of the invention which follows taken in conjunction with the accompanying drawings.

BRIEF DESCRIPTION OF THE DRAWINGS

In the drawings:

FIG. 6D is a top view of the shoe sole shown in FIG. 5, wherein

FIGS. 14A–14F show the naturally contoured sides design extended to the other natural contours underneath the load-bearing foot such as the main longitudinal arch;

FIG. 17 shows a method of establishing the theoretically ideal stability plane using a line perpendicular to a line tangent to a sole surface; and FIG. 18 shows an embodiment wherein the contour of the sole according to the invention is approximated by a plurality of line segments.

DETAILED DESCRIPTION OF THE PREFERRED EMBODIMENTS

Figure 1:
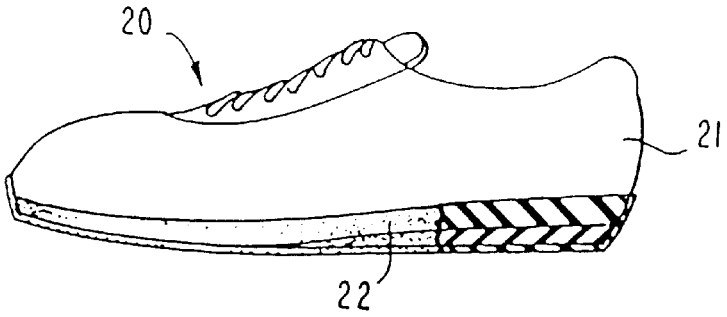
FIG. 1 (PRIOR ART)
FIG. 1 is a perspective view of a typical prior art running shoe to which the improvement of the present invention is applicable.

A perspective view of an athletic shoe, such as a typical running shoe, according to the prior art, is shown in FIG. 1 wherein a running shoe 20 includes an upper portion 21 and a sole 22. Typically, such a sole includes a truncated outwardly flared construction, wherein the lower portion of the sole heel is significantly wider than the upper portion where the sole 22 joins the upper 21. A number of alternative sole designs are known to the art, including the design shown in U.S. Pat. No. 4,449,306 to Cavanagh wherein an outer portion of the sole of the running shoe includes a rounded portion having a radius of curvature of about 20 mm. The rounded portion lies along approximately the rear-half of the length of the outer side of the mid-sole and heel edge areas wherein the remaining border area is provided with a conventional flaring with the exception of a transition zone. The U.S. Pat. No. 4,557,059 to Misevich, also shows an athletic shoe having a contoured sole bottom in the region of the first foot strike, in a shoe which otherwise uses an inverted flared sole.

Figure 2:
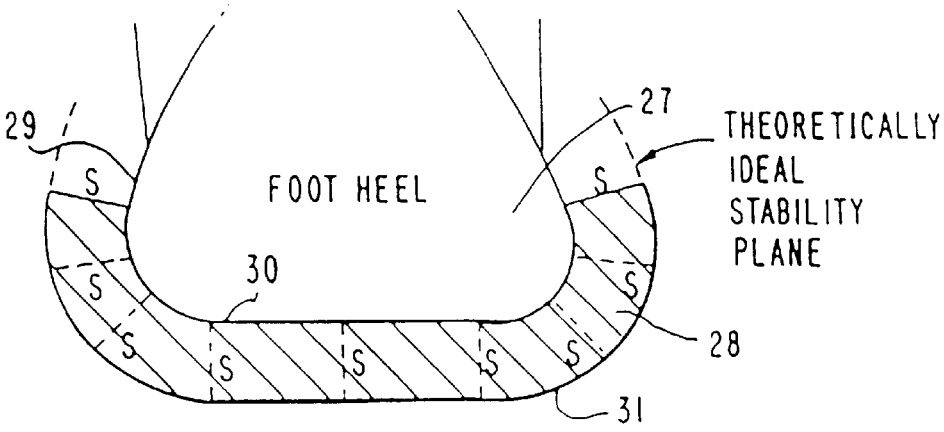
FIG. 2 is a frontal plane cross section showing a shoe sole of uniform thickness that conforms to the natural shape of the human foot, the novel shoe design according to the invention.

FIG. 2 shows in a frontal plane cross section at the heel (center of ankle joint) the general concept of the applicant's design: a shoe sole 28 that conforms to the natural shape of the human foot 27 and that has a constant thickness (s) in frontal plane cross sections. The surface 29 of the bottom and sides of the foot 27 should correspond exactly to the upper surface 30 of the shoe sole 28. The shoe sole thickness is defined as the shortest distance (s) between any point on the upper surface 30 of the shoe sole 28 and the lower surface 31 by definition, the surfaces 30 and 31 are consequently parallel. In effect, the applicant's general concept is a shoe sole 28 that wraps around and conforms to the natural contours of the foot 27 as if the shoe sole 28 were made of a theoretical single flat sheet of shoe sole material of uniform thickness, wrapped around the foot with no distortion or deformation of that sheet as it is bent to the foot's contours. To overcome real world deformation problems associated with such bending or wrapping around contours, actual construction of the shoe sole contours of uniform thickness will preferably involve the use of multiple sheet lamination or injection molding techniques.

Figure 3A:
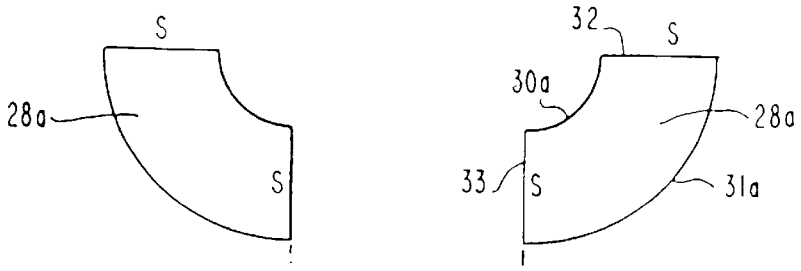
FIGS. 3A–3D show a load-bearing flat component of a shoe sole and naturally contoured stability side component, as well as a preferred horizontal periphery of the flat load-bearing portion of the shoe sole when using the sole of the invention.
Figure 3B:
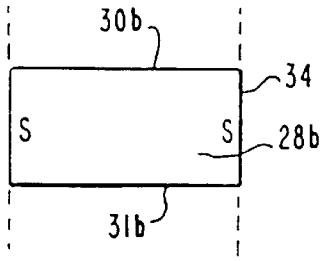
Figure 3C:
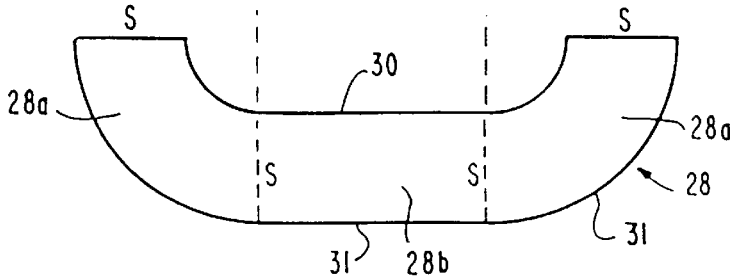
Figure 3D:
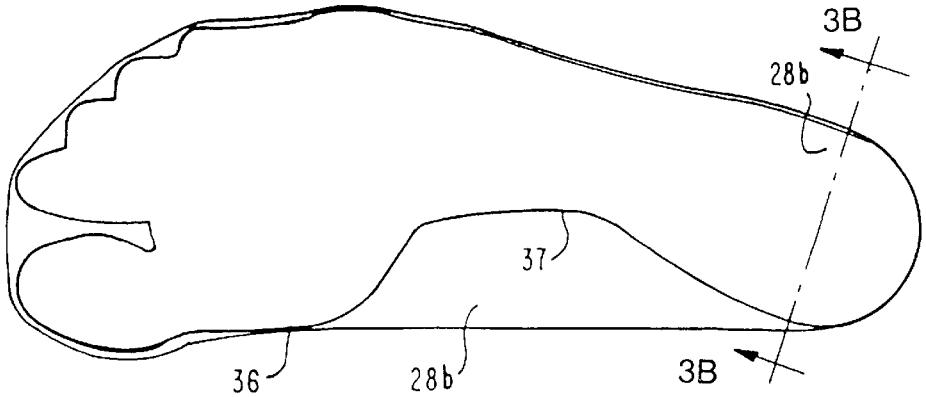
Figure 6A:
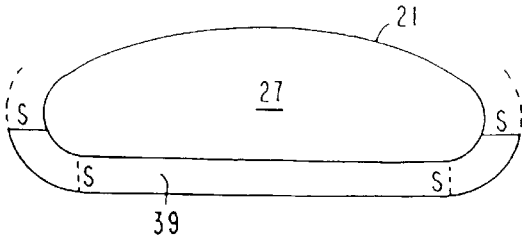
FIG. 6A is a cross-sectional view of the forefoot portion taken along lines 6A of FIG. 5 or 6D.
Figure 6B:
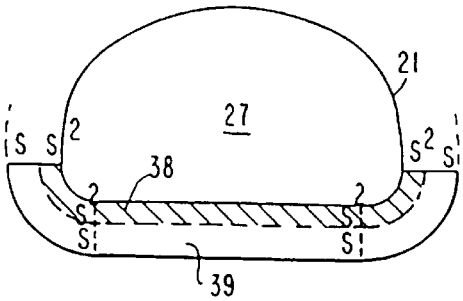
FIG. 6B is a view taken along lines 6B of FIGS. 5 and 6D.
Figure 6C:
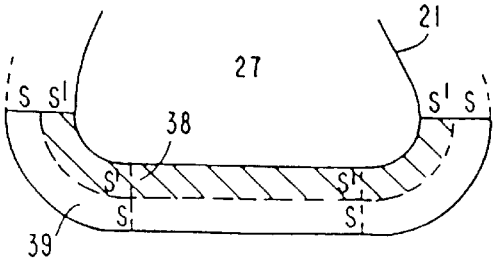
FIG. 6C is a cross-sectional view taken along the heel along lines 6C in FIGS. 5 and 6D.
Figure 6D:
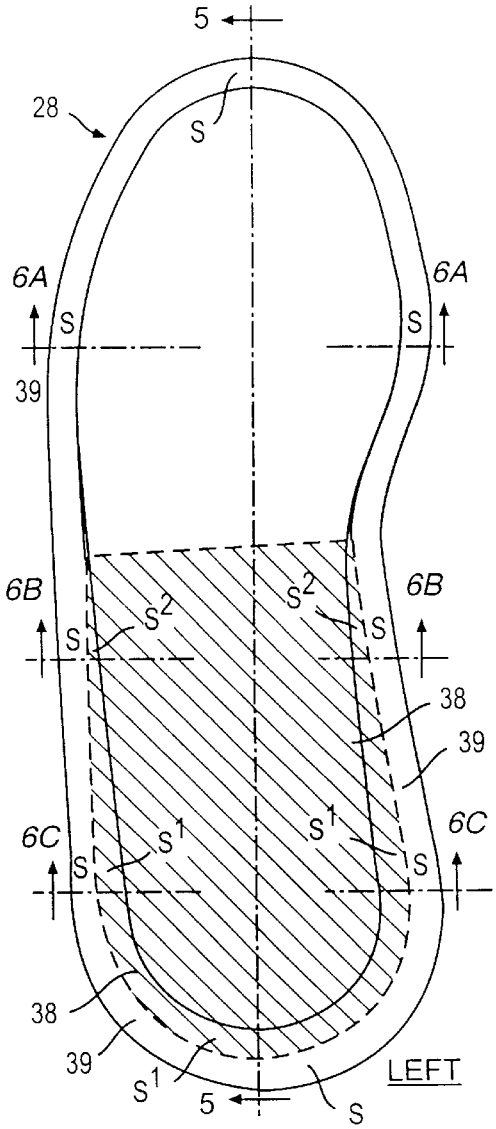
Figure 7A:
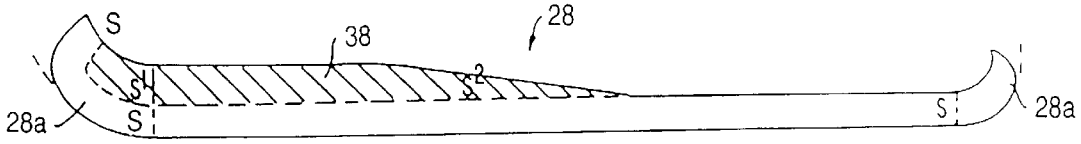
FIGS. 7A–7E show a plurality of side sagittal plane cross-sectional views showing examples of conventional sole thickness variations to which the invention can be applied.
Figure 7B:
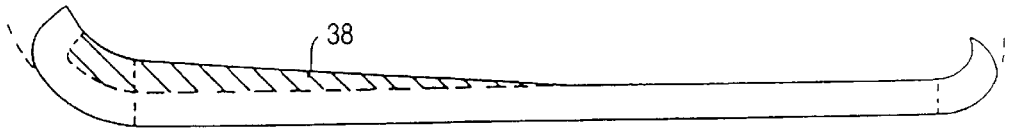
Figure 7C:
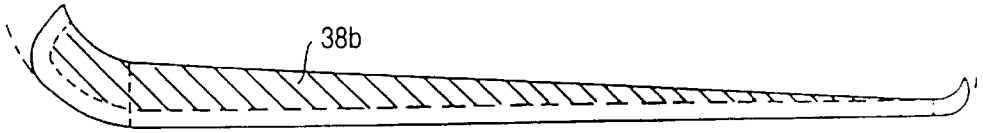
Figure 7D:
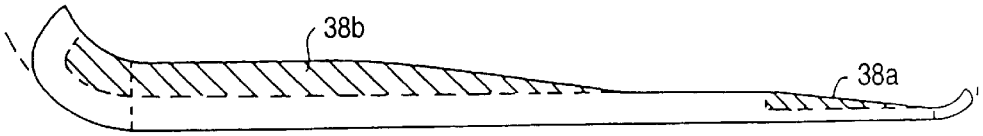
Figure 7E:
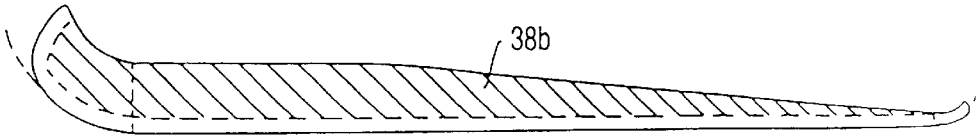

FIGS. 3A, 3B, and 3C illustrate in frontal plane cross section a significant element of the applicant's shoe design in its use of naturally contoured stabilizing sides 28*a* at the outer edge of a shoe sole 28*b* illustrated generally at the reference numeral 28. It is thus a main feature of the applicant's invention to eliminate the unnatural sharp bottom edge, especially of flared shoes, in favor of a naturally contoured shoe sole outside 31 as shown in FIG. 2. The side or inner edge 30*a* of the shoe sole stability side 28*a* is contoured like the natural form on the side or edge of the human foot, as is the outside or outer edge 31*a* of the shoe sole stability side 28*a* to follow a theoretically ideal stability plane. According to the invention, the thickness (s) of the shoe sole 28 is maintained exactly constant, even if the shoe sole is tilted to either side, or forward or backward. Thus, the naturally contoured stabilizing sides 28*a*, according to the applicant's invention, are defined as the same as the thickness 33 of the shoe sole 28 so that, in cross section, the shoe sole comprises a stable shoe sole 28 having at its outer edge naturally contoured stabilizing sides 28*a* with a surface 31*a* representing a portion of a theoretically ideal stability plane and described by naturally contoured sides equal to the thickness (s) of the sole 28. The top of the shoe sole 30*b* coincides with the shoe wearer's load-bearing footprint, since in the case shown the shape of the foot is assumed to be load-bearing and therefore flat along the bottom. A top edge 32 of the naturally contoured stability side 28*a* can be located at any point along the contoured side 29 of the foot, while the inner edge 33 of the naturally contoured side 28*a* coincides with the perpendicular sides 34 of the load-bearing shoe sole 28*b*. In practice, the shoe sole 28 is preferably integrally formed from the portions 28*b* and 28*a*. Thus, the theoretically ideal stability plane includes the contours 31*a* merging into the lower surface 31*b* of the sole 28. Preferably, the peripheral extent 36 of the load-bearing portion of the sole 28*b* of the shoe includes all of the support structures of the foot but extends no further than the outer edge of the foot sole 37 as defined by a load-bearing footprint, as shown in FIG. 3D, which is a top view of the upper shoe sole surface 30*b*. FIG. 3D thus illustrates a foot outline at numeral 37 and a recommended sole outline 36 relative thereto. Thus, a horizontal plane outline of the top of the load-bearing portion of the shoe sole, therefore exclusive of contoured stability sides, should, preferably, coincide as nearly as practicable with the load-bearing portion of the foot sole with which it comes into contact. Such a horizontal outline, as best seen in FIGS. 3D and 6D, should remain uniform throughout the entire thickness of the shoe sole eliminating negative or positive sole flare so that the sides are exactly perpendicular to the horizontal plane as shown in FIG. 3B. Preferably, the density of the shoe sole material is uniform.

Figure 4A:
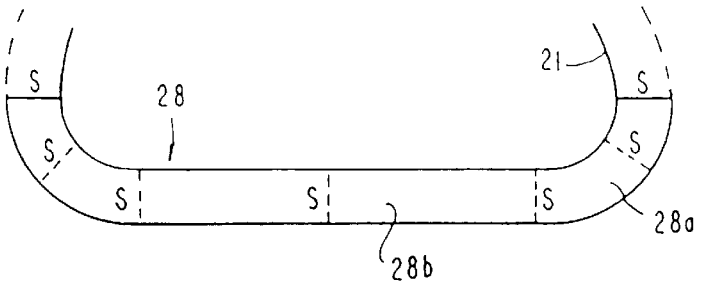
FIGS. 4A and 4B are diagrammatic sketches showing the novel contoured side sole design according to the invention with variable heel lift.
Figure 4B:
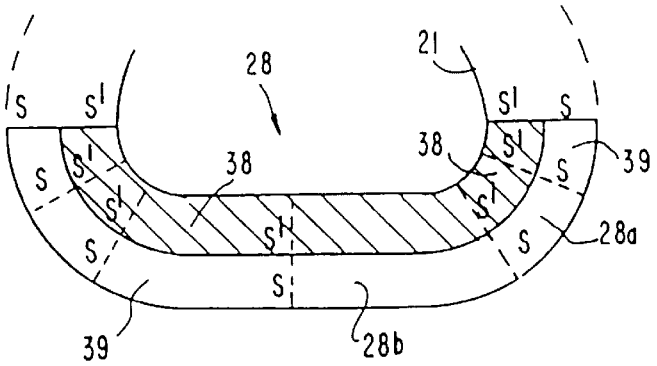

Another significant feature of the applicant's invention is illustrated diagrammatically in FIGS. 4A and 4B. Preferably, as the heel lift or wedge 38 of thickness (s1) increases the total thickness (s+s1) of the combined midsole and outersole 39 of thickness (s) in an aft direction of the shoe, the naturally contoured sides 28*a* increase in thickness exactly the same amount according to the principles discussed in connection with FIGS. 3A–3D. Thus, according to the applicant's design, the thickness of the inner edge 33 of the naturally contoured side is always equal to the constant thickness (s) of the load-bearing shoe sole 28*b* in the frontal cross-sectional plane.

As shown in FIG. 4B, for a shoe that follows a more conventional horizontal plane outline, the sole can be improved significantly according to the applicant's invention by the addition of a naturally contoured side 28*a* which correspondingly varies with the thickness of the shoe sole and changes in the frontal plane according to the shoe heel lift 38. Thus, as illustrated in FIG. 4B, the thickness of the naturally contoured side 28*a* in the heel section is equal to the thickness (s+s1) of the shoe sole 28 which is thicker than the shoe sole 39 thickness (s) shown in FIG. 5A by an amount equivalent to the heel lift 38 thickness (s1). In the generalized case, the thickness (s) of the contoured side is thus always equal to the thickness (s) of the shoe sole.

Figure 5:
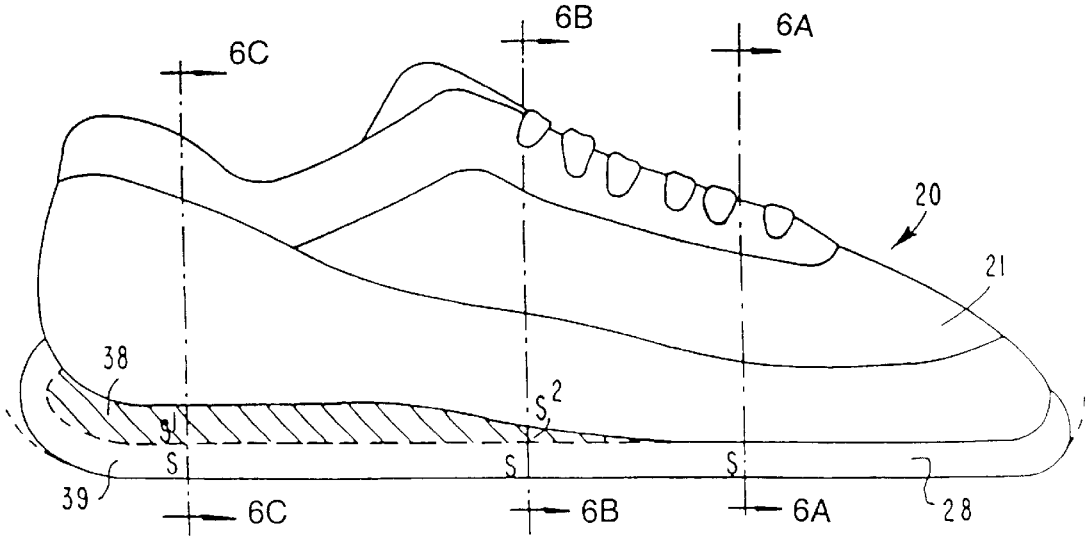
FIG. 5 is a side view of the novel stable contoured shoe according to the invention showing the contoured side design.

FIG. 5 illustrates a side cross-sectional view of a shoe to which the invention has been applied and is also shown in a top plane view in FIG. 6. Thus, FIGS. 6A, 6B and 6C represent frontal plane cross-sections taken along the forefoot, at the base of the fifth metatarsal, and at the heel, thus illustrating that the shoe sole thickness is constant at each frontal plane cross-section, even though that thickness varies from front to back, due to the heel lift 38 as shown in FIG. 5, and that the thickness of the naturally contoured sides is equal to the shoe sole thickness in each FIGS. 6A–6C cross section.

Moreover, in FIG. 6D, a horizontal plane overview of the left foot, it can be seen that the contour of the sole follows the preferred principle in matching, as nearly as practical, the load-bearing sole print shown in FIG. 3D.

FIGS. 7A–7E show typical conventional sagittal plane shoe sole thickness variations, such as heel lifts or wedges 38, or toe taper 38*a*, or full sole taper 38*b*, in FIGS. 7A–7E and how the naturally contoured sides 28*a* equal and therefore vary with those varying thicknesses as discussed in connection with FIGS. 4A and 4B.

Figure 8A:
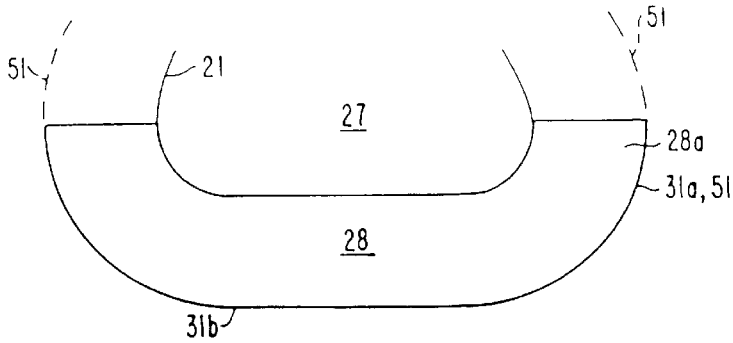
FIGS. 8A–8C show frontal plane cross-sectional views of the shoe sole according to the invention showing a theoretically ideal stability plane and truncations of the sole side contour to reduce shoe bulk.
Figure 8B:
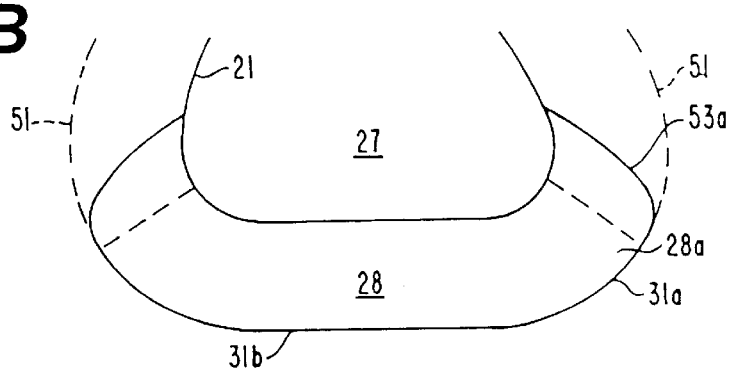
Figure 8C:
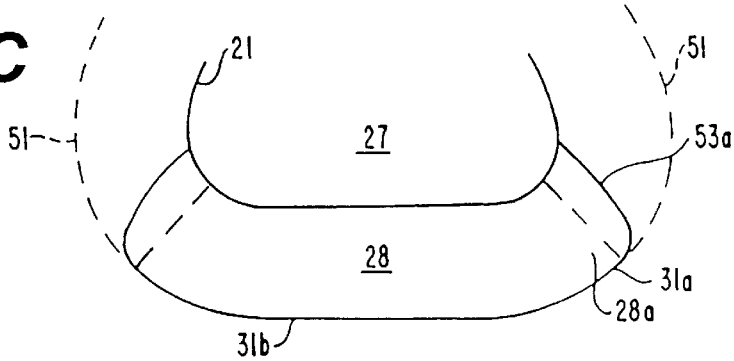
Figure 8D:
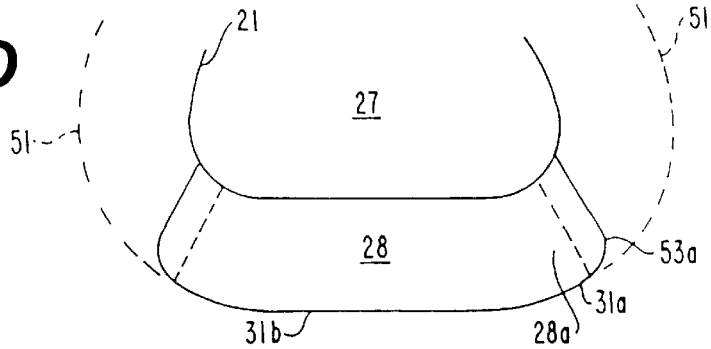

FIGS. 8A–8D illustrate an embodiment of the invention which utilizes varying portions of the theoretically ideal stability plane 51 in the naturally contoured sides 28*a* in order to reduce the weight and bulk of the sole, while accepting a sacrifice in some stability of the shoe. Thus, FIG. 8A illustrates the preferred embodiment as described above in connection with FIGS. 4A and 4B wherein the outer edge 31*a* of the naturally contoured sides 28*a* follows a theoretically ideal stability plane 51. As in FIGS. 2 and 3A–3D, the contoured surfaces 31*a*, and the lower surface of the sole 31*b* lie along the theoretically ideal stability plane 51. The theoretically ideal stability plane 51 is defined as the plane of the surface of the bottom of the shoe sole 31, wherein the shoe sole conforms to the shape of the wearer's foot sole, particularly the sides, and has a constant thickness in frontal plane cross sections. As shown in FIG. 8B, an engineering trade off results in an abbreviation within the theoretically ideal stability plane 51 by forming a naturally contoured side surface 53*a* approximating the natural contour of the foot (or more geometrically regular, which is less preferred) at an angle relative to the upper plane of the shoe sole 28 so that only a smaller portion of the contoured side 28*a* defined by the constant thickness lying along the surface 31*a* is coplanar with the theoretically ideal stability plane 51. FIGS. 8C and 8D show similar embodiments wherein each engineering trade-off shown results in progressively smaller portions of contoured side 28*a*, which lies along the theoretically ideal stability plane 51. The portion of the surface 31*a* merges into the upper side surface 53*a* of the naturally contoured side.

The embodiment of FIGS. 8A–8D may be desirable for portions of the shoe sole which are less frequently used so that the additional part of the side is used less frequently. For example, a shoe may typically roll out laterally, in an inversion mode, to about 20° on the order of 10° times for each single time it rolls out to 40°. For a basketball shoe, shown in FIG. 8B, the extra stability is needed. Yet, the added shoe weight to cover that infrequently experienced range of motion is about equivalent to covering the frequently encountered range. Since, in a racing shoe this weight might not be desirable, an engineering trade-off of the type shown in FIG. 8D is possible. A typical running/jogging shoe is shown in FIG. 8C. The range of possible variations is limitless, but includes at least the maximum of 90 degrees in inversion and eversion, as shown in FIG. 8A.

Figure 9A:
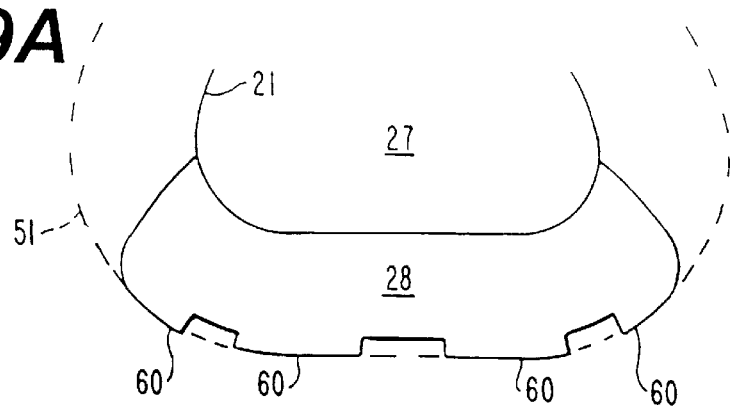
FIGS. 9A–9C show the contoured sole design according to the invention when applied to various tread and cleat patterns.
Figure 9B:
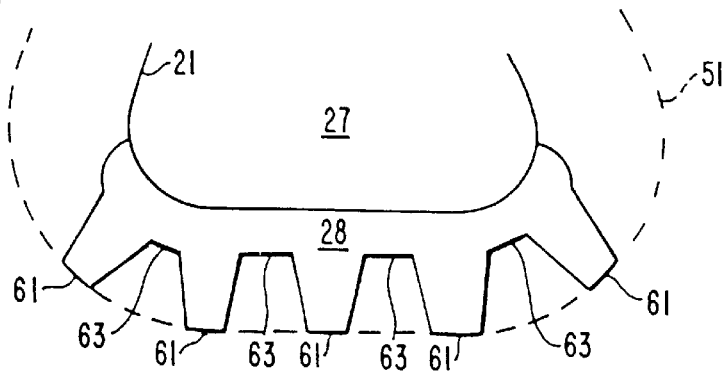
Figure 9C:
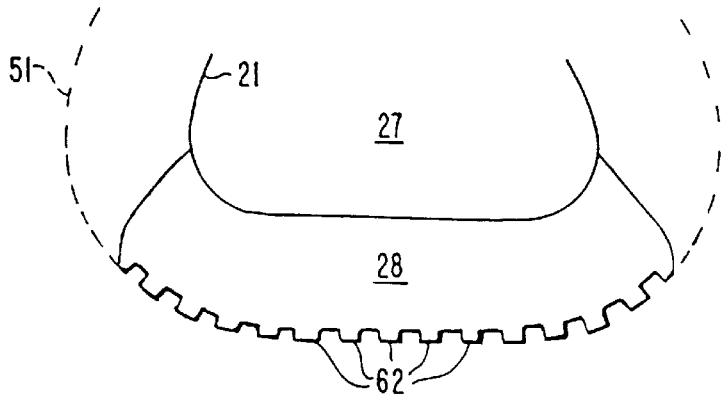

FIGS. 9A–9C show the theoretically ideal stability plane 51 in defining embodiments of the shoe sole having differing tread or cleat patterns. Thus, FIGS. 9A–9C illustrate that the invention is applicable to shoe soles having conventional bottom treads. Accordingly, FIG. 9A is similar to FIG. 8B further including a tread portion 60, while FIG. 9B is also similar to FIG. 8B wherein the sole includes a cleated portion 61. The surface 63 to which the cleat bases are affixed should preferably be on the same plane and parallel the theoretically ideal stability plane 51, since in soft ground that surface rather than the cleats become load-bearing. The embodiment in FIG. 9C is similar to FIG. 8C showing still an alternative tread construction 62. In each case, the load-bearing outer surface of the tread or cleat pattern 60–62 lies along the theoretically ideal stability plane 51.

Figure 10:
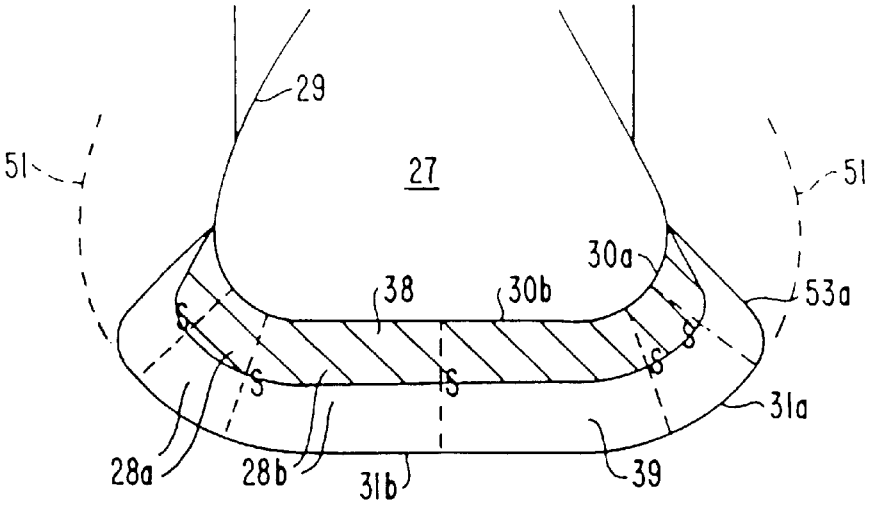
FIG. 10 illustrates, in a rear view, an application of the sole according to the invention to a shoe to provide an aesthetically pleasing and functionally effective design.

FIG. 10 shows, in a rear cross sectional view, the application of the invention to a shoe to produce an aesthetically pleasing and functionally effective design. Thus, a practical design of a shoe incorporating the invention is feasible, even when applied to shoes incorporating heel lifts 38 and a combined midsole and outersole 39. Thus, use of a sole surface and sole outer contour which track the theoretically ideal stability plane does not detract from the commercial appeal of shoes incorporating the invention.

Figure 11:
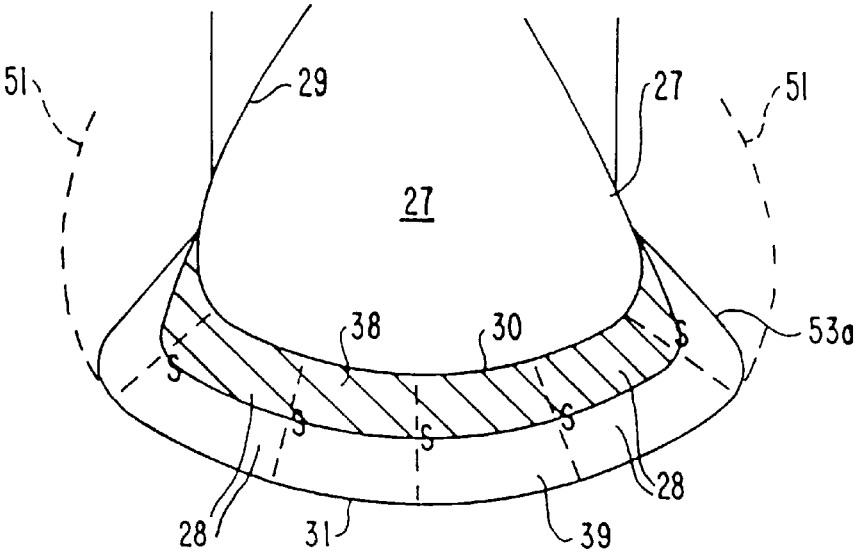
FIG. 11 shows a fully contoured shoe sole design that follows the natural contour of the bottom of the foot as well as the sides.

FIG. 11 shows a fully contoured shoe sole design that follows the natural contour of all of the foot, the bottom as well as the sides. The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 11 would deform by flattening to look essentially like FIG. 10. Seen in this light, the naturally contoured side design in FIG. 10 is a more conventional, conservative design that is a special case of the more general fully contoured design in FIG. 11, which is the closest to the natural form of the foot, but the least conventional. The amount of deformation flattening used in the FIG. 10 design, which obviously varies under different loads, is not an essential element of the applicant's invention.

FIGS. 10 and 11 both show in frontal plane cross section the essential concept underlying this invention, the theoretically ideal stability plane, which is also theoretically ideal for efficient natural motion of all kinds, including running, jogging or walking. FIG. 11 shows the most general case of the invention, the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29, to which the theoretically ideal stability plane 51 is by definition parallel.

For the special case shown in FIG. 10, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30b, which is defined as the upper surface of the shoe sole that is in physical contact with and supports the human foot sole, as shown in FIGS. 3A–3D.

The theoretically ideal stability plane for the special case is composed conceptually of two parts. Shown in FIGS. 10 and 3A–3D the first part is a line segment 31*b* of equal length and parallel to 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*; consequently, the inner and outer contoured edges 31A and 30A are by definition parallel.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described. It can be stated unequivocally that any shoe sole contour, even of similar contour, that exceeds the theoretically ideal stability plane will restrict natural foot motion, while any less than that plane will degrade natural stability, in direct proportion to the amount of the deviation.

Figure 12:
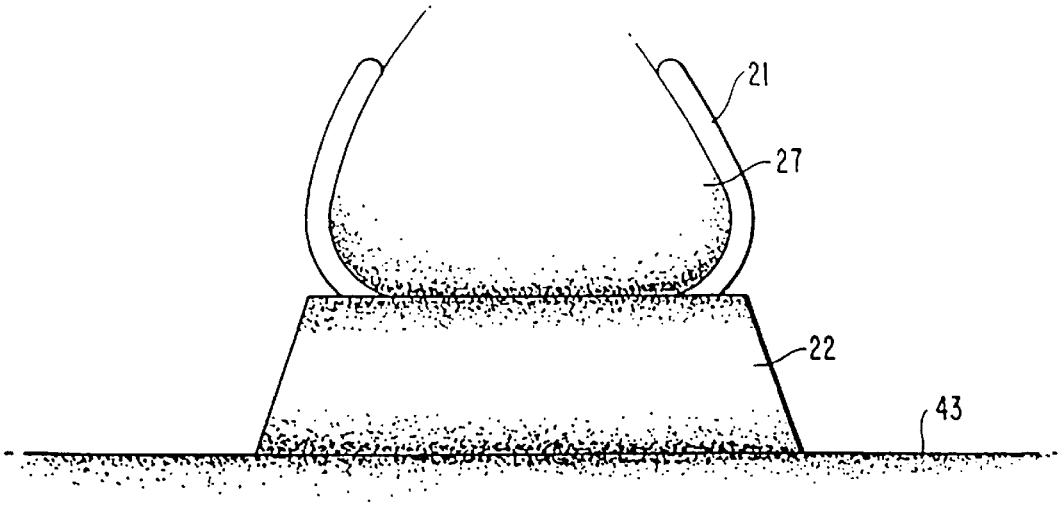
FIGS. 12 and 13 show a rear diagrammatic view of a human heel, as relating to a conventional shoe sole (FIG. 12) and to the sole of the invention (FIG. 13)

FIG. 12 illustrates, in a pictorial fashion, a comparison of a cross section at the ankle joint of a conventional shoe with a cross section of a shoe according to the invention when engaging a heel. As seen in FIG. 12, when the heel of the foot 27 of the wearer engages an upper surface of the shoe sole 22, the shape of the foot heel and the shoe sole is such that the conventional shoe sole 22 conforms to the contour of the ground,43 and not to the contour of the sides of the foot 27. As a result, the conventional shoe sole 22 cannot follow the natural 70 inversion/eversion motion of the foot, and that normal motion is resisted by the shoe upper 21, especially when strongly reinforced by firm heel counters and motion control devices. This interference with natural motion represents the fundamental misconception of the currently available designs. That misconception on which existing shoe designs are based is that, while shoe uppers are considered as a part of the foot and conform to the shape of the foot, the shoe sole is functionally conceived of as a part of the ground and is therefore shaped flat like the ground, rather than contoured like the foot.

Figure 13:
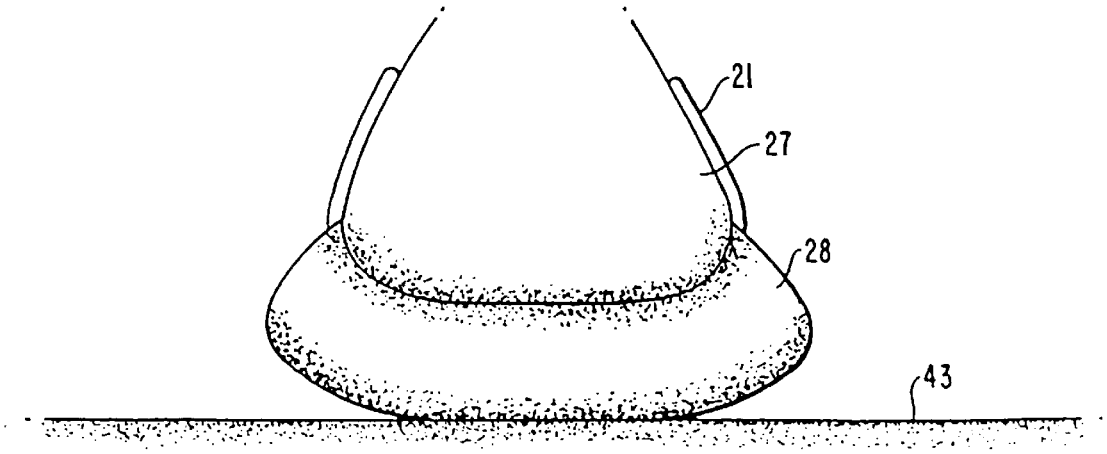
Figure 15A:
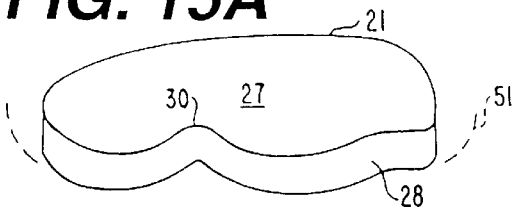
FIGS. 15A–15E illustrate the fully contoured shoe sole design extended to the bottom of the entire non-load-bearing foot.
Figure 15B:
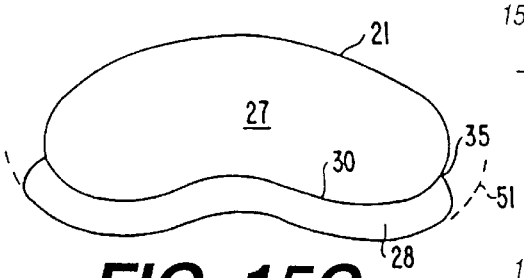
Figure 15C:
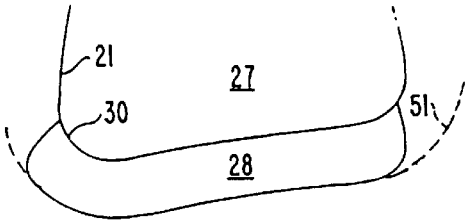
Figure 15D:
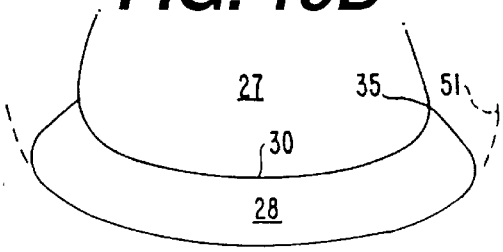

In contrast, the new design, as illustrated in FIG. 13, illustrates a correct conception of the shoe sole 28 as a part of the foot and an extension of the foot, with shoe sole sides contoured exactly like those of the foot, and with the frontal plane thickness of the shoe sole between the foot and the ground always the same and therefore completely neutral to the natural motion of the foot. With the correct basic conception, as described in connection with this invention, the shoe can move naturally with the foot, instead of restraining it, so both natural stability and natural efficient motion coexist in the same shoe, with no inherent contradiction in design goals.

Thus, the contoured shoe design of the invention brings together in one shoe design the cushioning and protection typical of modern shoes, with the freedom from injury and functional efficiency, meaning speed, and/or endurance, typical of barefoot stability and natural freedom of motion. Significant speed and endurance improvements are anticipated, based on both improved efficiency and on the ability of a user to train harder without injury.

FIGS. 14A–14D illustrate, in frontal plane cross sections, the naturally contoured sides design extended to the other natural contours underneath the load-bearing foot, such as the main longitudinal arch, the metatarsal (or forefoot) arch, and the ridge between the heads of the metatarsals (forefoot) and the heads of the distal phalanges (toes). As shown, the shoe sole thickness remains constant as the contour of the shoe sole follows that of the sides and bottom of the load-bearing foot. FIG. 14E shows a sagittal plane cross section of the shoe sole conforming to the contour of the bottom of the load-bearing foot, with thickness varying according to the heel lift 38. FIG. 14F shows a horizontal plane top view of the left foot that shows the areas 85 of the shoe sole that correspond to the flattened portions of the foot sole that are in contact with the ground when load-bearing. Contour lines 86 and 87 show approximately the relative height of the shoe sole contours above the flattened load-bearing areas 85 but within roughly the peripheral extent 35 of the upper surface of sole 30 shown in FIGS. 3A–3D. A horizontal plane bottom view (not shown) of FIG. 14F would be the exact reciprocal or converse of FIG. 14F (i.e. peaks and valleys contours would be exactly reversed).

More particularly, FIGS. 14C and 14D disclose a shoe sole 28 having a sole inner surface 30 adjacent the location of an intended wearer's foot 27 inside the shoe including at least a first concavely rounded portion 43, as viewed in a frontal plane. The concavity being determined relative to the location of an intended wearer's foot 27 inside the shoe, during an upright, unloaded shoe condition. The shoe sole 28 further includes a lateral or medial sidemost section 45 defined by that part of the side of the shoe sole 28 located outside of a straight line 55 extending vertically from a sidemost extent 46 of the sole inner surface 30, as viewed in the frontal plane during a shoe upright, unloaded condition. A sole outer surface 31 extends from the sole inner surface 30 and defines the outer boundary of the sidemost section 45 of the side of the shoe sole 28, as viewed in the frontal plane. The shoe sole 28 further including a second concavely rounded portion 44 forming at least the outer sole surface 31 of the sidemost section 45, the concavity being determined relative to the location of an intended wearer's foot 27 inside the shoe, as viewed in the frontal plane during a shoe upright, unloaded condition. The second concavely rounded portion 44 extending through a sidemost extent 47 of the sole outer surface 31 of the sole sidemost section 45, as viewed in the frontal plane during an upright, unloaded condition. Further, the second concavely rounded portion 44 extends to a height above a horizontal line 48 through the lowermost point of the sole inner surface 30, as viewed in the frontal plane in the heel area 51 during an upright, unloaded shoe condition. FIG. 14C illustrates the above aspects of the shoe sole 28 at the shoe midtarsal area 52 located between the forefoot area 50 and the heel area 49.

Figure 15E:
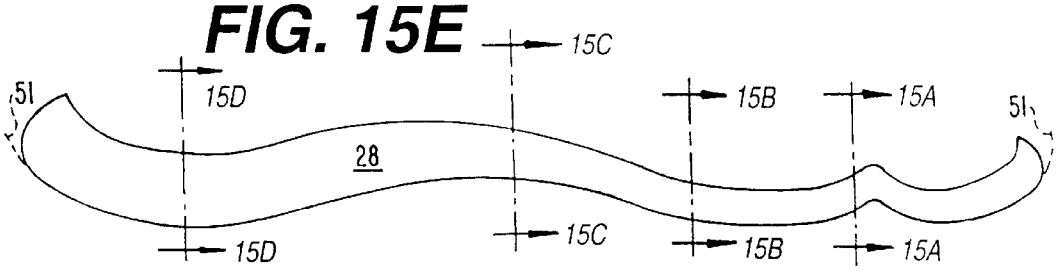

FIGS. 15A–15D show, in frontal plane cross sections, the fully contoured shoe sole design extended to the bottom of the entire non-load-bearing foot. FIG. 15E shows a sagittal plane cross section. The shoe sole contours underneath the foot are the same as FIGS. 14A–14E except that there are no flattened areas corresponding to the flattened areas of the load-bearing foot. The exclusively rounded contours of the shoe sole follow those of the unloaded foot. A heel lift 38, the same as that of FIGS. 14A–14D, is incorporated in this embodiment, but is not shown in FIGS. 15A–15D.

Figure 16:
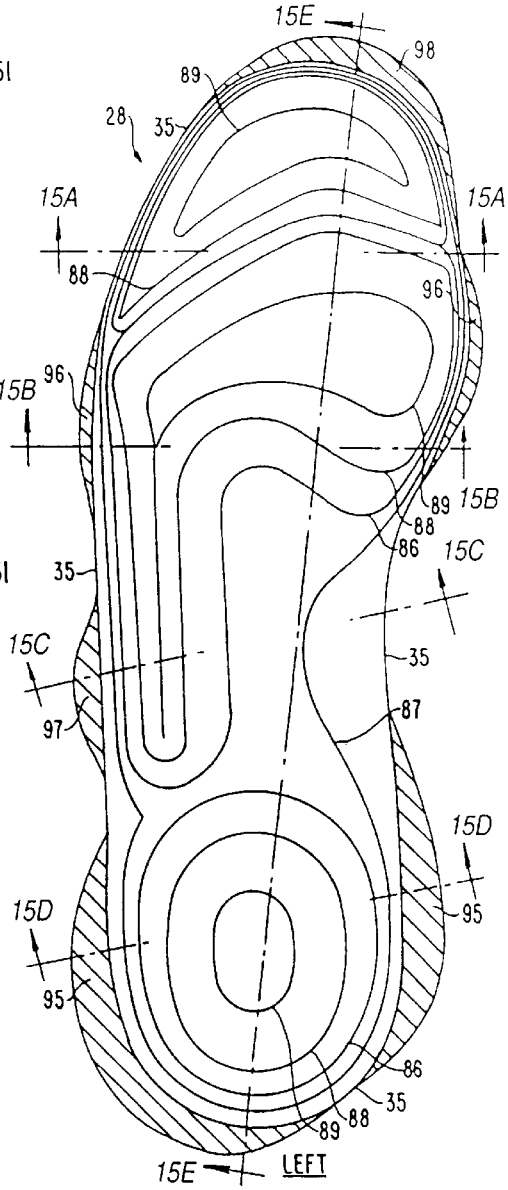
FIG. 16 shows the fully contoured shoe sole design abbreviated along the sides to only essential structural support and propulsion elements.

FIG. 16 shows the horizontal plane top view of the left foot corresponding to the fully contoured design described in FIGS. 14A–14E, but abbreviated along the sides to only essential structural support and propulsion elements. Shoe sole material density can be increased in the unabbreviated essential elements to compensate for increased pressure loading there. The essential structural support elements are the base and lateral tuberosity of the calcaneus 95, the heads of the metatarsals 96, and the base of the fifth metatarsal 97. They must be supported both underneath and to the outside for stability. The essential propulsion element is the head of first distal phalange 98. The medial (inside) and lateral (outside) sides supporting the base of the calcaneus are shown in FIG. 15 oriented roughly along either side of the horizontal plane subtalar ankle joint axis, but can be located also more conventionally along the longitudinal axis of the shoe sole. FIG. 15 shows that the naturally contoured stability sides need not be used except in the identified essential areas. Weight savings and flexibility improvements can be made by omitting the nonessential stability sides. Contour lines 86 through 89 show approximately the relative height of the shoe sole contours within roughly the peripheral extent [35 of the undeformed upper surface of shoe sole 30 shown in FIGS. 3A–3D. A horizontal plane bottom view (not shown) of FIG. 15 would be the exact reciprocal or converse of FIG. 15 (i.e. peaks and valleys contours would be exactly reversed).

FIG. 17 illustrates the method of measuring sole thickness in accordance with the present invention. The sole thickness is defined as the distance between a first point on the inner surface 30 of the sole 28 and a second point on the outer surface 31 of the sole 28, the second point being located along a straight line perpendicular to a straight line tangent to the inner surface 30 of the sole 28 at the first point, as viewed in a shoe sole frontal plane when the shoe sole is upright and in an unloaded condition.

The theoretically ideal stability can also be approximated by a plurality of line segments 110, such as tangents, chords, or other lines, as shown in FIG. 18. Both the upper surface of the shoe sole 28, which coincides with the side of the foot 30*a*, and the bottom surface 31*a* of the naturally contoured side can be approximated. While a single flat plane 110 approximation may correct many of the biomechanical problems occurring with existing designs, because it can provide a gross approximation of the both natural contour of the foot and the theoretically ideal stability plane 51, the single plane approximation is presently not preferred, since it is the least optimal. By increasing the number of flat planar surfaces formed, the curve more closely approximates the ideal exact design contours, as previously described. Single and double plane approximations are shown as line segments in the cross section illustrated in FIG. 18.

Thus, it will clearly be understood by those skilled in the art that the foregoing description has been made in terms of the preferred embodiment and various changes and modifications may be made without departing from the scope of the present invention which is to be defined by the appended claims.

What is claimed is:

1. A sole for an athletic shoe comprising:

a combined midsole and outersole;

a sole heel area at a location substantially corresponding to the location of a heel of an intended wearer's foot when inside the shoe;

a sole forefoot area at a location substantially corresponding to the location of a forefoot of the intended wearer's foot when inside the shoe;

a sole third portion at a location substantially corresponding to the area between the heel and the forefoot of the intended wearer's foot when inside the shoe;

a sole lateral side, a sole medial side and a sole middle portion located between the sole lateral side and the sole medial side;

a lateral sidemost section and a medial sidemost section, each at a location outside of a straight vertical line extending through the sole at a sidemost extent of the inner surface of the combined midsole and outersole, as viewed in a frontal plane cross-section when the shoe sole is upright and in an unloaded condition;

the sole having a greater sole thickness in the sole heel area than a sole thickness in the sole forefoot area, as viewed in respective sole heel area and sole forefoot area frontal plane cross-sections when the shoe sole is upright and in an unloaded condition;

at least one heel area sole side located at at least one of the sole lateral side and the sole medial side in the sole heel area, each said at least one heel area sole side comprising:

a) a concave portion of an outer surface of the shoe sole extending from below a height of a lowermost point of an inner surface of the combined midsole and outersole down said heel area sole side, as viewed in a shoe sole heel area frontal plane cross-sections when the shoe sole is upright and in an unloaded condition, the concavity existing with respect to an inner section of the shoe sole directly adjacent to the concave sole outer surface portion, b) a convex portion of an inner surface of the combined midsole and outersole, as viewed in a shoe sole heel area frontal plane cross-section when the shoe sole is upright and in an unloaded condition, the convexity existing with respect to a section of the combined midsole and outersole directly adjacent to the convex inner surface portion of the combined midsole and outersole, c) the combined midsole and outersole extending into the sidemost section of the same said heel area sole side, as viewed in the sole heel area frontal plane cross-section when the shoe sole is upright and in an unloaded condition, and d) an upper part of the combined midsole and outsole extending up said heel area sole side to above a level corresponding to a lowest point of the inner surface of the combined midsole and outersole of the same said heel area sole side, as viewed in the sole heel area frontal plane cross-section when the shoe sole is upright and in an unloaded condition;

at least one sole side located at at least one of the sole medial side and the sole lateral side in the sole third portion, each said at least one sole side of the sole third portion comprising:

a) a concave portion of the outer surface of the shoe sole extending up said sole side, as viewed in a frontal plane cross-section in the sole third portion when the shoe sole is upright and in an unloaded condition the concavity being determined relative to an inner section of the shoe sole directly adjacent to the concave sole outer surface portion, b) a convex portion of an inner surface of the combined midsole and outersole, as viewed in a shoe sole frontal plane cross-section in the sole third portion when the shoe sole is upright and in an unloaded condition, the convexity existing with respect to a section of the combined midsole and outersole directly adjacent to the convex inner surface portion of the combined midsole and outersole, c) at least a portion of the combined midsole and outersole extending into the sidemost section of the same sole side of the sole third portion, as viewed in a frontal plane cross-section in the sole third portion when the shoe sole is upright and in an unloaded condition, d) an upper part of the combined midsole and outersole extending up the sole side to above a level corresponding to a lowest point of the inner surface of the combined midsole and outersole of the same sole side of the sole third portion, as viewed in a frontal plane cross-section in the sole third portion when the shoe sole is upright and in an unloaded condition, and e) a thickness between the inner surface of the combined midsole and outersole and the outer surface of the shoe sole increases gradually from a thickness at an uppermost point of each said sole side of the sole third portion to a greater thickness at a location below the uppermost point of each said sole side of the sole third portion, as viewed in a frontal plane cross-section in the sole third portion when the shoe sole is upright and in an unloaded condition;

at least one of the concave portions of the sole outer surface is formed by a series of at least three substantially straight line segments of the sole outer surface, as viewed in at least one of a heel area frontal plane cross-section and a frontal plane cross-section in the sole third portion, when the shoe sole is upright and in an unloaded condition;

at least part of a lowest line segment extends substantially to a lowermost point of the outer surface of the shoe sole, as viewed in a frontal plane cross-section in at least one of a sole heel area and sole third portion, when the shoe sole is upright and in an unloaded condition; and at least part of the third sole portion comprises an indentation relative to a straight line between a lowermost part of the sole outer surface of the sole heel portion and a lowermost part of the sole outer surface of the sole forefoot portion, all as viewed in a shoe sole sagittal plane cross-section when the shoe sole is upright and in an unloaded condition.

2. The shoe sole as claimed in claim 1, wherein at least one of the convex portions of the inner surface of the combined midsole and outersole is formed by a series of at least three substantially straight line segments of the inner surface of the combined midsole and outersole, as viewed in at least one heel area and frontal plane cross-section in the sole third portion when the shoe sole is upright and in an unloaded condition.

3. The shoe sole as claimed in claim 1, wherein one said sole side of the sole third portion is located on the sole lateral side of the sole third portion.

4. The shoe sole as claimed in claim 1, wherein one said sole side of the sole third portion is located on the sole medial side of the sole third portion.

5. The shoe sole as claimed in claim 1, comprising two sole sides of the sole third portion, one being located on the sole medial side of the sole third portion and the second being located on the sole lateral side of the sole third portion.

6. The shoe sole as claimed in claim 5, wherein said heel area sole side is located at the sole lateral side of the sole heel area.

7. The shoe sole as claimed in claim 5, wherein said heel area sole side is located at the sole medial side of the sole heel area.

8. The shoe sole as claimed in claim 5, comprising two heel area sole sides, one being located on the sole medial side of the sole heel area and the second being located on the sole lateral side of the sole heel area.

9. The shoe sole as claimed in claim 1, wherein one said heel area sole side is located on the sole lateral side of the sole heel area.

10. The shoe sole as claimed in claim 1, wherein one said heel area sole side is located on the sole medial side of the sole heel area.

11. The shoe sole as claimed in claim 1, comprising two heel area sole sides, one being located on the sole medial side of the sole heel area and the second being located on the sole lateral side of the sole heel area.

12. The shoe sole as claimed in claim 1, wherein the concave portion of the sole outer surface of at least one of the sole heel and sole third portion sole sides extends to a sidemost extent of the same sole side, as viewed in a frontal plane cross-section in said at least one of the sole heel area and sole third portion, respectively, when the shoe sole is upright and in an unloaded condition.

13. The shoe sole as claimed in claim 12, wherein the concave portion of the sole outer surface of at least one of the sole heel area and sole third portion sole sides extends to a lowermost portion of the same sole side, as viewed in a frontal plane cross-section in at least one of the sole heel area and sole third portion, respectively, when the shoe sole is upright and in an unloaded condition.

14. The shoe sole as claimed in claim 12, wherein the concave portion of the sole outer surface of at least one of the sole heel area and sloe third portion sole sides extends through and beyond a lowermost portion of the same sole side, as viewed in a frontal plane cross-sections in at least one of the sole heel area and sole third portion, respectively, when the shoe sole is upright and in an unloaded condition.

15. The shoe sole as claimed in claim 12, wherein the concave portion of the sole outer surface of at least one of the sole heel area and sole third portion sole sides extends into the sole middle part, as viewed in a frontal plane cross-section in at least one of the sole heel area and sole third portion, respectively, when the shoe sole is upright and in an unloaded condition.

16. The shoe sole as claimed in claim 12, wherein the concave portion of the sole outer surface of at least one of the sole heel area and sole third portion sole sides extends to a centerline of the sole middle part, as viewed in a frontal plane cross-section in at least one of the sole heel area and sole third portion, respectively, when the shoe sole is upright and in an unloaded condition.

17. The shoe sole as claimed in claim 12, wherein the concave portion of the sole outer surface of at least one of the sole heel area and sole third portion sole sides extends through and beyond a sidemost extent of the same sole side, as viewed in a frontal plane cross-sections in at least one of the sole heel area and sole third portion, respectively, when the shoe sole is upright and in an unloaded condition.

18. The shoe sole as claimed in claim 12, wherein the concave portion of the sole outer surface of at least one of the heel area and sole third portion sole sides extends up the same sole side to at least the level of the lowest point of the inner surface of the midsole component of the same sole side, as viewed in a frontal plane cross-section in at least one of the sole heel area and sole third portion, respectively, when the shoe sole is upright and in an unloaded condition.

19. The shoe sole as claimed in claim 12, wherein the concave portion of the sole outer surface of at least one of the sole heel area and sole third portion sole sides extends up the same sole side to above the height of the lowest point of the inner surface of the combined midsole and outersole of the same sole side, as viewed in a frontal plane cross-section in at least one of the sole heel area and sole third portion, respectively, when the shoe sole is upright and in an unloaded condition.

20. The shoe sole as claimed in claim 12, wherein the concave portion of the sole outer surface of at least one of the sole heel area and sole third portion sole sides extends to an uppermost part of the same sole side, as viewed in a frontal plane cross-section in at least one of the sole heel area and sole third portion, respectively, when the shoe sole is upright and in an unloaded condition.

21. The shoe sole as claimed in claim 20, wherein the concave portion of the sole outer surface of at least one of the sole heel area and sole third portion sole sides extends to a lowermost portion of the same sole side, as viewed in a frontal plane cross-section in at least one of the sole heel area and sole third portion, respectively, when the shoe sole is upright and in an unloaded condition.

22. The shoe sole as claimed in claim 1, wherein the sole outer surface of a rearmost part of the sole heel area comprises a concave portion, as viewed in a sagittal plane cross section when the shoe sole is upright an in an unloaded condition, the concavity being determined relative to an inner section of the shoe sole directly adjacent to the concave outer surface portion of the shoe sole.

23. The shoe sole as claimed in claim 1, wherein the inner surface of the combined midsoleand outersole of the sole heel area further comprises a convex portion, as viewed in a sagittal plane cross section when the shoe sole is upright and in an unloaded condition, the convexity being determined relative to a section of the shoe sole directly adjacent to the convex inner surface portion of the combined midsole and outersole.

24. A shoe sole as claimed in claim 23, wherein the substantially uniform thickness of the shoe sole is different when measured in at least two separate frontal plane cross-sections.

25. The shoe sole as claimed in claim 1, wherein the sole outer surface of the sole heel area further comprises a concave portion, as viewed in a sagittal plane cross-section when the shoe sole is upright and in an unloaded condition, the concavity being determined relative to an inner section of the shoe sole located directly adjacent to the concave outer surface portion of the shoe sole.

26. The shoe sole as claimed in claim 25, wherein the sole inner surface of a rearmost part of the sole heel area comprises a convex portion, as viewed in a sagittal plane cross-section when the shoe sole is upright and in an unloaded condition, the convexity being determined relative to a section of the shoe sole located directly adjacent to the convex inner surface portion of the shoe sole.

27. The shoe sole as claimed in claim 26, wherein an uppermost part of the combined midsole and outersole of the rearmost part of the sole heel area extends up a rear of the sole heel area to above the level of the lowest point of the sole inner surface of the rear of the sole heel area, as viewed in a sagittal plane cross-section when the shoe sole is upright and in an unloaded condition.

28. The shoe sole as claimed in claim 1, wherein substantially all of the thickness increase between the inner surface of the combined midsole and outersole and the outer surface of the shoe sole in at least one of said uppermost portions of the shoe sole sides results from the sole outer surface diverging from a centerline of the shoe sole, as viewed in a frontal plane cross-section when the shoe sole is upright and in an unloaded condition.

29. The shoe sole as claimed in claim 1, wherein the thickness between the inner surface of the combined midsole and outersole and the outer surface of the shoe sole in at least one of said uppermost portions of the shoe sole sides increases from the uppermost point of the shoe sole side to a sidemost extent of the same shoe sole side, as viewed in a frontal plane cross-section in the sole third portion when the shoe sole is upright and in an unloaded condition.

30. The shoe sole as claimed in claim 1, wherein the thickness between the inner surface of the combined midsole and outersole and the outer surface of the shoe sole in at least one of said uppermost portions of the shoe sole sides increases gradually and substantially continuously.

31. The shoe sole as claimed in claim 1, wherein the inner surface of the combined midsole and outersole substantially conforms to the shape of an intended wearer's foot, as viewed in a sagittal plane cross section in at least one of the sole heel area and the sole third portion, when the shoe sole is upright and in an unloaded condition.

32. The shoe sole as claimed in claim 1, wherein at least two of said concave outer surface portions are formed by a series of at feast three substantially straight line segments of the sole outer surface, as viewed in a frontal plane cross-section in at least one of the soleheel area and the sole third portion when the shoe sole is upright and in an unloaded condition.

33. The shoe sole as claimed in claim 1, comprising at least three concave outer surface portions, and wherein at least three of said concave outer surface portions are formed by a series of at least three substantially straight line segments of the sole outer surface, as viewed in a frontal plane cross-section in at least one of the sole heel area and the sole third portion when the shoesole is upright and in an unloaded condition.

34. The shoe sole as claimed in claim 1, comprising at least four concave outer surface portions, and wherein at least four of said concave outer surface portions are formed by a series of at least three substantially straight line segments of the sole outer surface, as viewed in a frontal plane cross-section in at least one of the sole heel area and the sole third portion when the shoe sole is upright and in an unloaded condition.

35. The shoe sole as claimed in claim 1, wherein all of said concave outer surface portions are formed by a series of at least three substantially straight line segments of the sole outer surface, as viewed in a frontal plane cross-section in at least one of the sole heel area and the sole third portion when the shoe sole is upright and in an unloaded condition.

36. The shoe sole as claimed in claim 35, wherein two adjacent straight line segments of the convex portions of the inner surface of the combined midsole and outersole form an obtuse angle between the straight line sections, relative to a section of the shoe sole directly adjacent to said respective concave portion of the sole outer surface, as viewed in a frontal plane cross-section in at least one of the sole heel area and and the sole third portion when the shoe sole is upright and in an unloaded condition.

37. The shoe sole as claimed in claim 35, wherein two different pairs of two adjacent straight line segments of the convex portions of the inner surface of the combined midsole and outersole form an obtuse angle between the straight line sections, relative to a section of the shoe sole directly adjacent to said respective convex portion of the inner surface of the combined midsole and outersole, as viewed in a frontal plane cross-section in at least one of the sole heel area and the sole third portion when the shoe sole is upright and in an unloaded condition.

38. The shoe sole as claimed in claim 1, wherein two adjacent, substantially straight line segments of the sole outer surface form an obtuse angle between the straight line segments, relative to an inner section of the shoe sole directly adjacent to said respective concave portion of the sole outer surface, as viewed in a frontal plane cross-section in at least one of the sole heel area and the sole third portion when the shoe sole is upright and in an unloaded condition.

39. The shoe sole as claimed in claim 1, wherein two different pairs of two adjacent, substantially straight line segments of the sole outer surface form an obtuse angle between the straight line segments, relative to an inner section of the shoe sole directly adjacent to said respective concave portion of the sole outer surface, as viewed in a frontal plane cross-sections in at least one of the sole heel area and and the sole third portion when the shoe sole is upright and in an unloaded condition.

40. A shoe sole as claimed in claim 1, wherein at least a portion of the shoe sole located between at least one of said concavely rounded portions of the sole outer surface and one of said convexly rounded portions of the inner surface of the combined midsole and outersole has a substantially uniform thickness extending sufficiently to provide direct load-bearing support between the sole of the foot and the ground through a sideways tilt of at least 20 degrees, as viewed in a frontal plane cross-section when the shoe sole is upright and in an unloaded condition.

41. A shoe sole as claimed in claim 40, wherein at least two of said portions of the shoe sole located between at least one of said concavely rounded portions of the sole outer surface and one of said convexly rounded portions of the inner surface of the combined midsole and outersole have a substantially uniform thickness extending sufficiently to provide direct load-bearing support between the sole of the foot and the ground through a sideways tilt of at least 20 degrees, as viewed in a frontal plane cross-section when the shoe sole is upright and in an unloaded condition.

42. A shoe sole as claimed in claim 41, wherein at least three of said portions of the shoe sole located between at least one of said concavely rounded portions of the sole outer surface and one of said convexly rounded portions of the inner surface of the combined midsole and outersole have a substantially uniform thickness extending sufficiently to provide direct load-bearing support between the sole of the foot and the ground through a sideways tilt of at least 20 degrees, as viewed in a frontal plane cross-section when the shoe sole is upright and in an unloaded condition.

43. A shoe sole as claimed in claim 1, wherein at least a portion of at least one of said portions of the shoe sole located between at least one of said concavely rounded portions of the sole outer surface and one of said convexly rounded portions of the inner surface of the combined midsole and outersole has a substantially uniform thickness extending substantially to a sidemost extent of the shoe sole side, as viewed in a frontal plane cross-section when the shoe sole is upright and in an unloaded condition.

44. A shoe sole as claimed in claim 43, wherein at least two of said portions of the shoe sole located between at least one of said concavely rounded portions of the sole outer surface and one of said convexly rounded portions of the inner surface of the combined midsole and outersole have a substantially uniform thickness extending substantially to a sidemost extent of the shoe sole side, as viewed in a frontal plane cross-section when the shoe sole is upright and in an unloaded condition.

45. A shoe sole as claimed in claim 44, wherein at least three of said portions of the shoe sole located between at least one of said concavely rounded portions of the sole outer surface and one of said convexly rounded portions of the inner surface of the combined midsole and outersole have a substantially uniform thickness extending substantially to a sidemost extent of the shoe sole side, as viewed in a frontal plane cross-section when the shoe sole is upright and in an unloaded condition.

46. A shoe sole as claimed in claim 45, wherein the substantially uniform thickness of the shoe sole is different when measured in at least two separate frontal plane cross-sections.

47. A shoe sole as claimed in claim 1, wherein the at least three substantially straight line segments of the sole outer surface form a substantially continuous approximation of a concavely rounded portion of the sole outer surface, as viewed in at least one of a heel area frontal plane cross-section and a frontal plane cross-section in the sole third portion, when the shoe sole is upright and in an unloaded condition.

* * * * *